US007536844B2

(12) United States Patent
Aubin et al.

(10) Patent No.: US 7,536,844 B2
(45) Date of Patent: May 26, 2009

(54) DEVICE AND PROCESS FOR PACKAGING TYRES

(75) Inventors: Rudy Aubin, Orleat (FR); Dorian Berthelot, Montaigut-le-Blanc (FR); Daniel Moulier, Chateaugay (FR); René Plaisance, Pessat-Villeneuve (FR); Bernard Sergere, Paslieres (FR)

(73) Assignee: Michelin Recherche et Technique S.A., Granges-Paccot (CH)

( * ) Notice: Subject to any disclaimer, the term of this patent is extended or adjusted under 35 U.S.C. 154(b) by 440 days.

(21) Appl. No.: 11/297,438

(22) Filed: Dec. 9, 2005

(65) Prior Publication Data

US 2006/0156694 A1 Jul. 20, 2006

(30) Foreign Application Priority Data

Dec. 16, 2004 (FR) ..... 04 13470

(51) Int. Cl.
*B65B 11/06* (2006.01)
*B65B 11/58* (2006.01)

(52) U.S. Cl. ..... 53/582; 53/399; 53/449; 53/588

(58) Field of Classification Search ..... 53/399, 53/449, 170, 203, 212, 588, 582, 586
See application file for complete search history.

(56) References Cited

U.S. PATENT DOCUMENTS 4,858,415 A 8/1989 Hake
4,920,729 A * 5/1990 Doster et al. ..... 53/523
5,092,106 A 3/1992 Doster et al.
5,161,349 A * 11/1992 Lancaster et al. ..... 53/399
5,182,894 A * 2/1993 Bate ..... 53/399
5,259,325 A 11/1993 Pilger
5,408,808 A * 4/1995 Masuda et al. ..... 53/556
5,423,161 A * 6/1995 Huson et al. ..... 53/449
5,816,142 A * 10/1998 Keller et al. ..... 100/35
6,527,499 B2 3/2003 Leimbach et al.
7,299,744 B2 * 11/2007 Charvet ..... 100/2
2001/0028838 A1 10/2001 Leimbach et al.

FOREIGN PATENT DOCUMENTS

| | | |
|---|---|---|
| EP | 11-189214 | 7/1999 |
| EP | 2001-106211 | 4/2001 |
| EP | 1 452 449 | 9/2004 |
| FR | 2 243 115 | 4/1975 |

* cited by examiner

*Primary Examiner*—Hemant M Desai
(74) *Attorney, Agent, or Firm*—Buchanan Ingersoll & Rooney PC

(57) ABSTRACT

A facility for the packaging of tires includes a pre-packaging station where a given number of tires constituting a unitary batch are arranged within an overall size in horizontal layers, a compression station at which the batch is compressed vertically in a direction essentially perpendicular to the plane of the layers, and a packing unit at which there are laid around the batch, under tension, straps of given width by wrapping a first strap about a first horizontal axis, and by helical winding a second strap about a second horizontal axis oriented perpendicular to the first axis. During the winding of straps, the batch is kept vertically compressed between two packing conveyors.

23 Claims, 15 Drawing Sheets

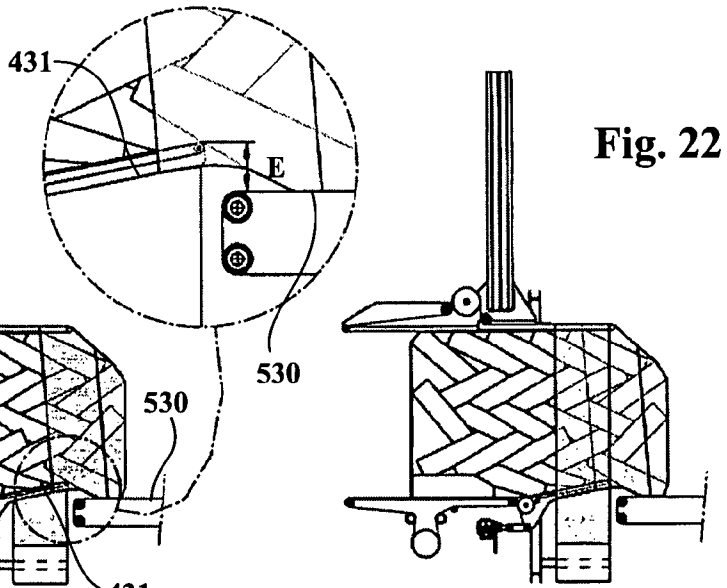
Fig. 22
Fig. 21
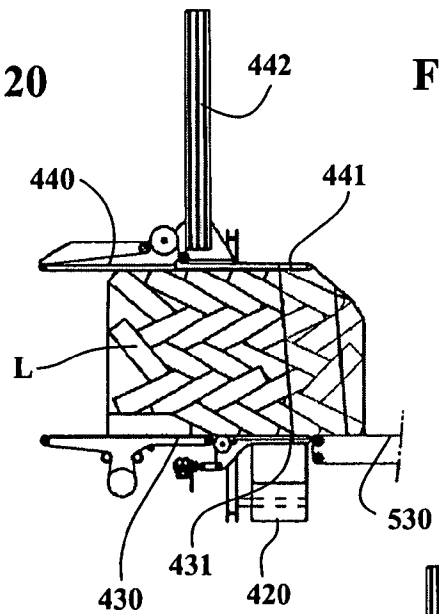
Fig. 20
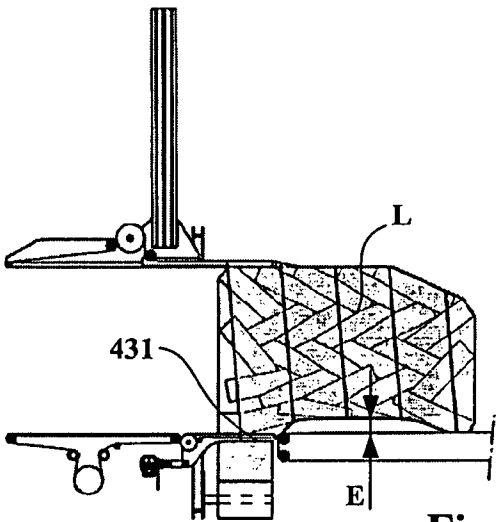
Fig. 24
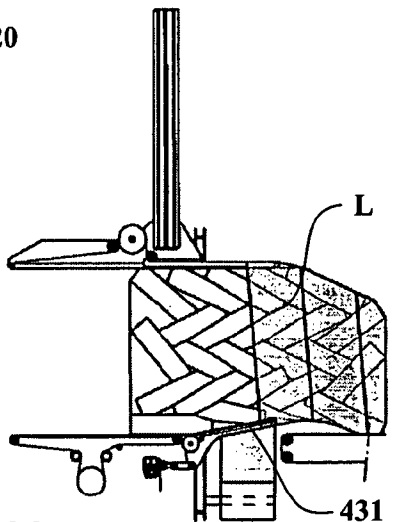
Fig. 23

DEVICE AND PROCESS FOR PACKAGING TYRES

This application claims priority under 35 U.S.C. §119 to patent application Ser. No. 04/13470 filed in France on Dec. 16, 2004.

BACKGROUND

The invention concerns the field of tyres and in particular the packaging and handling of tyre casings during their storage and transport.

The constant striving for greater productivity, along with a constant desire to improve the working conditions of those engaged in the field, has led various operators in the sector of industry concerned to optimise the logistical chain by acting to improve the conditions of storage in industrial depots, transport, loading and unloading operations, and the production of batches that are easy to identify and move as required by the needs of delivery or storage area optimisation, while preserving the integrity of the tyres.

A widely used system consists in using pallets whose size is specially chosen to be able to receive tyres of various dimensions and diameters. For example, a pallet currently used in storage depots is described in patent application U.S. Pat. No. 5,259,325, in which the tyres are stored in a stack or roll.

Pallets of this type have the advantages of constituting homogeneous batches of tyres, of being able to be arranged on top of one another to a great height, of being able to be manipulated by mechanical means of the fork-lift truck type, and of providing good protection for the tyres against external aggressions. On the other hand they are less suitable for transport, particularly on long journeys, because of the poor compactness of their loads and because of the need to arrange for the return of the empty pallets.

For transport over long distances it is desirable to fit the largest possible number of tyres into a given volume, regardless of whether it is a truck trailer, a marine container or a railway wagon. A system currently used is to arrange the tyres one above the other in a particular arrangement known as "herring-bone" or else "chain" and then put the volume so constituted under compression so as to optimise the load. These methods are described, for example, in the patent U.S. Pat. No. 5,092,106.

Although very effective for optimising the volume to be loaded, this last method nevertheless has the disadvantage of having to be implemented partly by hand, which is a limiting factor in terms of cost, ergonomics, batch integrity, or even storage.

In effect it is commonly found that each of the systems mentioned above represents an optimum solution for a particular field such as storage or transport, but it is rare for one and the same technical solution to be advantageous all along the logistical chain. This makes it necessary to vary the packaging as a function of the various stages of the said chain, and therefore entails particular handling operations which in part cancel the benefits achieved by choosing the system most suitable for a particular point along the logistical chain.

The purpose of the invention is to contribute towards reducing handling and transport costs, while also improving the ergonomics related to the storage and recovery operations.

It is known from the prior art to produce autonomous unitary packs from a given number of tyres arranged in a herring-bone pattern. These autonomous units, also called batches, can comprise several tens or even one or two hundred tyres depending on the tyre size and on the packaging volume chosen.

Thus, patent U.S. Pat. No. 6,527,499 describes a process which enables unitary packs to be made up in which the tyres are arranged in stacks or more commonly in the configuration called "herring-bone" and are then compressed vertically between two rigid plates, around which are arranged containing means that enable the batch of tyres to be kept under tension. Although compact, these unitary packs have the disadvantage of comprising recyclable supports whose management complicates the organisation of the logistical chain.

Another solution is disclosed in the patent FR 2 243 115, in which a process is described for producing a unitary pack formed from a batch of tyres again arranged in herring-bone configuration, compressed vertically and immobilised by containing means such as bands, straps, packaging fabrics or tension-resistant sheets, whose purpose is to keep the stack in shape and oppose elastic expansion. This process makes it possible to obtain autonomous unitary packs which are sufficiently rigid and can be manipulated without the help of special machinery.

However, the need to immobilise the unitary pack in its compacted condition entails a lengthy and relatively costly operation, whose careful implementation is an important factor for the actual volume and stability of the autonomous unit so formed. In effect, the positioning of the containing means while the unitary pack is kept in its compressed condition is a difficult operation. These two disadvantages limit both the size of the unitary packs and the degree of compression that can be obtained, at the risk of seeing the unitary pack disintegrate during a handling operation.

It is for that reason that patent FR 2 243 115 describes a preferred immobilisation process in which the tyres are stacked in a given order between two rigid end-stops, in such manner that once the compression operation has been carried out, the tyres only expand by a negligible amount because of the longitudinal forces exerted against the wall elements forming the end-stops, which block the elastic expansion of the compressed batch. This last arrangement again relies on the use of pallets comprising special uprights.

The purpose of the present invention is to propose a device and process that overcome the disadvantages mentioned above.

It was observed that by arranging strips by wrapping in quite particular directions around the batch of tyres to be packaged, it was possible to make a device that enables the said wrapping to be done while keeping the batch under compression in a relatively easy way.

This device for packaging tyre casings comprises:

- a pre-packaging station where a given number of tyres that constitute a single batch L are arranged within a certain overall size in one or more rows orientated longitudinally along an axis XX' and arranged in horizontal layers,
- a compression station that enables the batch L to be compressed in a direction substantially perpendicular to the plane of the layers,
- a packing unit consisting of one or more applicator systems that can position straps of a given width under tension around the batch L, by wrapping around a first, horizontal axis YY' which is substantially perpendicular to the axis XX', and by helical winding with variable pitch around a second axis essentially parallel to the direction XX', and two packing conveyors that can keep the batch L of tyres under compression during the positioning of the straps, a transfer assembly that can hold the batch of tyres during movements from one station to another, a clearing station.

By carrying out the helical winding of the strap simultaneously around the batch and the only downstream part of the packing conveyors, the downstream ends of the said packing conveyors can be disengaged from the space between the straps and the batch of tyres, moving the batch longitudinally relative to the downstream ends of the said packing conveyors by actuating the advance of the said conveyors. The dimensions and form of the packing conveyor must be adjusted so as to facilitate as much as possible the longitudinal sliding of the strap relative to the conveyor.

To ensure good cohesion of the packaged batch of tyres it is preferable to stack the tyres in successive horizontal layers in a "herring-bone" configuration:

Besides, by adjusting the degree of compression of the batch of tyres and the tension and pitch of the helical winding, it is possible to obtain a batch of tyres that can be manipulated easily and directly with the help of a conventional fork-lift truck without previously having to put the batch onto a rigid pallet. The packaged batch has sufficient structural rigidity to prevent its deformation when held at the bottom by the two forks of the truck.

As will be seen later in the context of a particular embodiment of the device, the shape of the batch of tyres can be modified in particular ways that facilitate the introduction of the forks under the packaged batch of tyres.

BRIEF DESCRIPTION OF THE DRAWINGS

The process and device are described with reference to the drawings shown in FIGS. 1 to 31, which represent:

FIGS. 20 to 24: Schematic views of various implementations of the spiral wrapping of the strap and the operation of the lower packing conveyor

DETAILED DESCRIPTION OF PREFERRED EMBODIMENT

Figure 1:
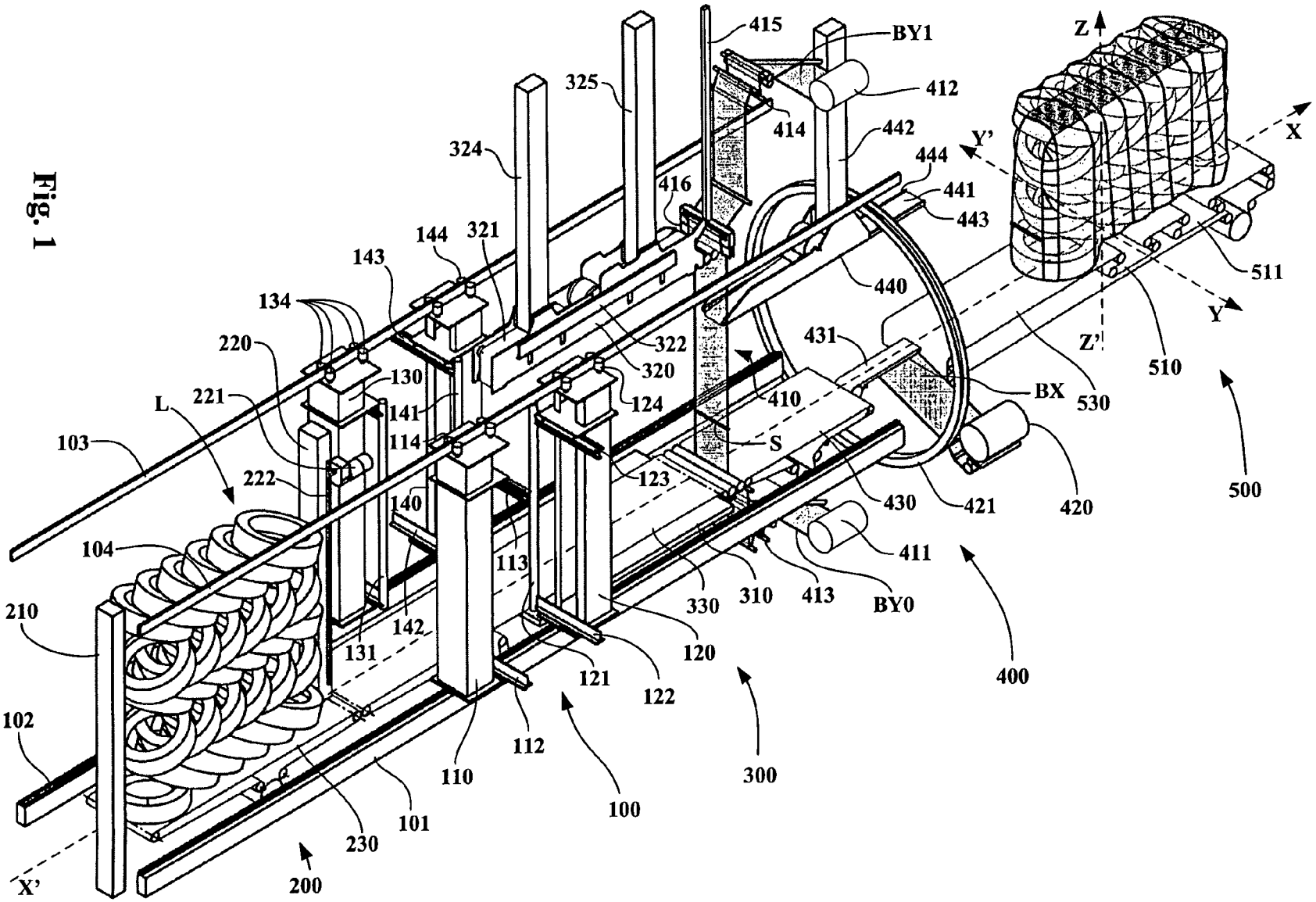
FIG. 1: Schematic perspective view of the packaging device

The device represented in FIG. 1 comprises a pre-packaging station 200, a compression station 300, a packing unit 400, a transfer assembly 100 and a clearing station 500.

The pre-packaging station 200 is located at the upstream end of the device, whose longitudinal direction is marked by the axis XX'. It is at this station that the batch of tyres L is made up. In order to obtain a packaged batch of suitable geometry the tyres are arranged within an overall space formed by two vertical planes perpendicular to the longitudinal axis and against which the tyres at the two longitudinal ends of the row forming the batch are in contact. In the precise case of the device which is the subject of the present description, the vertical planes are realised by two posts 210 and 220 centred on the axis XX'.

The preferred procedure is to stack the tyres in horizontal layers arranged vertically over one another to produce a batch L in a single row. Similarly, to ensure the best structural cohesion of the batch, the tyres will be arranged in the so-termed "herring-bone" configuration.

The stack may be made manually, or by mechanical means which are not the subject of this description.

Other configurations are possible, such as an arrangement in which each layer is offset longitudinally relative to the adjacent layers by half the diameter of the tyres. But although that arrangement has acceptable structural properties, it does not allow the batches produced to accommodate the maximum number of tyres within a given volume.

Similarly, although the batches can be arranged in several rows, it will be seen that for passenger car tyres of relatively large size and mass it is preferable to choose a single row.

The size of the overall space formed by the distance between the two posts 210 and 220 can be adjusted in the longitudinal direction. Their arrangement allows the operator easy access to the space between the two posts in order to make up the batch L.

The size of the pre-packaged batches is 15% to 60% higher than the size of the compressed batch eventually to be obtained. The length of the row is chosen judiciously and will for example be equal to the width, or a multiple of the width of a truck trailer or of a packaging unit of larger size such as a wagon or container used to transport the batches over long distances.

The number of tyres that can be combined in the same batch can range between a few tens and about a hundred tyre casings.

For the sake of information, the table below gives more precise indications of the minimum and maximum characteristics of batches made using the device which is the subject of the present description, arranging the tyres in a single row.

| | Minimum | Maximum |
|---|---|---|
| Number of tyres | 20 | 80 |
| Mass in kg | 200 | 500 |
| Length in mm | 2 250 | 2 380 |
| Width in mm | 400 | 800 |
| Height in mm | 740 | 1 450 |

The tyres are arranged on a conveyor 230 orientated in the longitudinal direction XX' and aligned with the conveyor of the compression station 230, the conveyors of the packaging unit 430 and 431, and the conveyor of the clearing station 530.

The downstream post 220 can be moved in the vertical direction ZZ' so as to enable the batch of tyres to move from the pre-packaging station to the compression station. For that purpose it is provided with a rack-bar 222 and a motor 221.

The device also comprises a transfer assembly 100 whose function is to ensure the longitudinal and transverse stability of the tyre batch L during transfer from one station to another, and to keep the batch within the dimensions imposed by the clearance of the pre-packaging station until the tyre batch has been correctly packaged.

The transfer assembly 100 consists of 4 transfer posts 110, 120, 130, 140 that can move in the longitudinal direction XX', and are arranged in pairs on either side of the conveyors 230, 330, 430, 431. These transfer posts rest on longitudinal rails 101 and 102, and are guided at their top by sets of rollers 114, 124, 134, 144 arranged on slideways 103 and 104.

Each of these transfer posts supports a holding bar 111 (not visible), 121, 131 and 141, which can move transversely and is guided at its top and bottom ends by rails 112, 113, 122, 123, 132 (not visible), 133 (not visible), 142 and 143, arranged in the transverse direction YY' at the tops and bottoms of the transfer posts 110, 120, 130 and 140. Transfer motors (not shown) powered by the automatic piloting system of the device bring about the longitudinal movements of the transfer posts and the transverse movements of the holding bars 111, 121, 131 and 141.

By bringing the holding bars 111, 121, 131, 141 into contact with the parts of the tyre batch located laterally on either side of the batch and at each of its longitudinal ends, the transfer station ensures that the cohesion of the batch is maintained within the dimensions conferred upon it at the prepackaging station. By moving the transfer posts longitudinally and acting upon the lower conveyors 230, 330, 430 in a synchronised manner, the batch can be transferred from one station to another without changing its dimensional characteristics.

The compression station 300 comprises two compression plates parallel to one another and perpendicular to the vertical direction ZZ'.

The upper plate consists of a chassis 320 supported by two vertically movable columns 324 and 325. These columns 324 and 325 are connected to a load application system (not shown) and are designed to raise or lower the upper compression plate by a given amount so as to vertically compress the tyre batch L in the direction perpendicular to the plane of the tyre layers. The load application system can be a mechanical system comprising an assembly of racks and pinions, or an assembly of hydraulic jacks, or any equivalent system for applying pressure. Its load capacity is of the order of 2 000 daN.

The upper plane 320 supports a conveyor 321 that can move in the longitudinal direction XX'. This conveyor can be of the belt or roller conveyor type. Preferably, the conveyor is motorised.

The length of the upper plate is adapted to the length of the row of the tyre batch L. Its width is made smaller than the width of the tyre batch L, or indeed than the diameter of the tyres when the latter are arranged in a single row. This sizing is preferred so as to allow movements of the upper plate relative to the holding bars when the latter are kept in contact with the batch L during the compression phase.

To avoid too large a deformation of the tyres in the upper part of the batch L, which will be in direct contact with the upper compression plate, this deformation being brought about by the pressure on the tyres by the upper compression plate when they are much wider than the width of the latter, the said upper compression plate is provided with two lateral flaps 322 and 323 (not visible) that can be retracted out of the way and are arranged longitudinally along the two sides of the chassis of the upper compression plate 320.

These retractable flaps pivot around an axis parallel to the longitudinal direction XX'. When lowered, they increase the contact area between the upper plate and the tyres. In this way excessive pinching of the tyres at the top of the batch when their diameter is large, is avoided. The flaps are kept in a raised position when the tyres to be packaged have a diameter only slightly larger than the width of the upper compression plate, and also during translation movements of the batch.

The lower plate consists of a vibratory table 310 above which the belt of the conveyor 330 circulates. The conveyor described in this case is a belt conveyor, but a roller conveyor could just as well be mounted over the vibratory table. Preferably, the conveyor 330 is motorised.

The function of the vibratory table 310 is to assist the positioning of the tyres relative to one another during the compression phase. For the sake of information, the vibratory table of type Europercussion™, model 2MV 10/2610-S90 of the device described in the present case has a vertical amplitude that can be adjusted between 0 and 10 mm and a frequency adjustable between 0 and 50 Hz.

The packing unit consists of an upper packing conveyor 440 and a lower packing conveyor 430 both orientated in the longitudinal direction, and two strap applicator systems consisting respectively of a stretch-wrapping bundler 410 and a strap winding machine 420.

The upper packing conveyor 440 is supported by a column 442 which enables the height of the conveyor's plane in contact with the upper part of the batch L to be adjusted. In practice, this height is essentially equal to the height of the plane of the upper compression plate 320 of the compression station 300 when the tyre batch has reached its maximum compression, so that the horizontal planes formed by the two conveyors are substantially coincident.

The lower packing conveyor 430 is located in the same plane as the conveyor of the lower compression plate 330.

The upper packing conveyor 440 and the lower packing conveyor 430 form horizontal planes that enable the batch of tyres to be kept in the compressed state, and between which the batch L can circulate in the longitudinal direction. It is thus possible to transfer the tyre batch from the compression station to the packing unit without in any way modifying the degree of compression of the tyre batch.

In the device described in the present case the conveyors 430, 431 and 441 are of the belt conveyor type, but in this case a roller-type conveyor could just as well be chosen. These conveyors are motorised.

Each of the packing conveyors has at its downstream end a portion 431, 441 whose width is substantially equal to the width of the upper compression plate 320. In practice the upper packing conveyor 440 consists of a single conveyor whose width is essentially equal to the width of the upper compression plate 320. For greater transfer stability the lower packing conveyor consists of two conveyors, the more upstream of which 430 being essentially the same width as the conveyor of the lower compression plate 330, while the more downstream one 431 is essentially the same width as the downstream end of the upper packing conveyor 441.

The downstream ends 431, 441 of each of the packing conveyors 430, 440 comprise shoulders (shown in detail in the detail insert of FIG. 18), (not shown) arranged on the lateral portions of the said downstream ends 431, 441. The said shoulders are orientated vertically in the direction opposite to the plane of the conveyor in contact with the batch of tyres to be packaged. These shoulders form longitudinal and mutually parallel ridges and are adjusted vertically in such manner that, for each of the downstream portions 431 and 441 of the conveyors, the horizontal planes passing through the said ridges are located respectively below (431) and above (441) the mobile elements of the said downstream portions of the packing conveyors.

The purpose of this configuration is to prevent contact between the mobile surfaces of the downstream ends 431 and 441 of the packing conveyors and the strap BX, when the said strap BX is wound simultaneously around the tyre batch L to be packaged and the said downstream ends 431 and 441 of the two packing conveyors. In other words the purpose of these shoulders, when the strap BX is stretched over the edges of the said shoulders, is to prevent any contact between the strap BX and the mobile portion of the packing conveyors which is not in contact with the batch of tyres. This mobile portion can consist of the return belt of a belt-type conveyor or of the respectively upper (441) or lower (431) part of an assembly of motorised rollers.

The downstream portion of the lower packing conveyor 431 is articulated about an axis essentially parallel to the transverse direction YY'. As will be seen later, the purpose of this arrangement, when the conveyor 431 is slightly raised, is to produce an increase in the compression of the lower part of the batch L.

The first applicator system 410 consists of a vertical stretch-wrapping bundler. The straps BY0 and BY1 are delivered by feed spools 411 and 412, and are connected together by a seam S to form a vertical curtain whose plane is perpendicular to the longitudinal direction XX'. This curtain is stretched by two roller systems 413 and 414 positioned respectively on the outside of the gap formed by the planes of the conveyors. The tension of the strap is adjustable and can vary between 1 and 100 daN in the device described in the present case.

The plane of the curtain is located in the free gap between the downstream ends of the conveyors of the compression station, respectively 330 and 321, and the upstream ends of the conveyors of the packing unit, respectively 430 and 440. The feed spools 411 and 412 deliver lengths of strap BY0 and BY1 on demand when the tyre batch engages in the packing unit. On its way downstream through the device, the batch is covered successively on its upstream front face and then on its lower and upper surfaces by the straps BY0 and BY1.

It will be seen that in the case of the device described here, the strap with axis YY' positioned by the bundler covers the two longitudinal faces located upstream and downstream of the batch and the upper and lower faces. But it is entirely possible to make a device which gives an equivalent result, in which a strap is wrapped around the upstream and downstream faces and the lateral faces along an axis essentially parallel to the vertical axis ZZ', by positioning a strip roller similar to that described below on a circular rail with its axis vertical.

The straps BY0 and BY1 preferably consist of a weldable material such as a stretch-film of high or low density polyethylene, obtained for example by a "cast" process or by extrusion and nowadays abbreviated in the forms LDPE or HDPE, whose thickness can range from 20 to 80 μm. The width of the straps can range from 150 to 600 mm and depends on the width of the tyre batch. Choosing a recyclable material also improves the economics of this type of packaging.

When the batch is completely engaged in the packing unit, a welding unit comprising an upper jaw 416 supported by a post 415, and a lower jaw (not shown) seals the curtain against the downstream front face, forming a continuous wrapping around the batch L. The axis of this wrapping is substantially parallel to the transverse direction YY'. The welding unit comprises a blade with which the wrapping can be separated from the curtain simply by cutting. A final weld S enables the curtain intended to wrap the next batch to be reconstituted.

For indicative purposes, the device described here is equipped with a bundler and a welding unit marketed, for example, by the company Thimon under reference Norket 50.

The packing unit is also equipped with a strap winding machine 420 designed to wind the strap BX helically and under tension along an axis essentially parallel to the longitudinal direction XX'.

This strap winding machine is arranged longitudinally opposite the downstream portions 431 and 441 of the packing conveyors 430 and 440, so as to wind the strap BX around the batch of tyres L while simultaneously enclosing the batch and the said downstream ends 431 and 441 between the strap and the lower and upper surfaces of the batch.

The strap winding machine 420 is supported by a circular rail 421 with axis XX', which enables it to wind the strap BX simultaneously around the tyre batch and the downstream ends 431 and 441 of the packing conveyors.

The strap BX is wound on under tension. This winding tension can usefully be produced by pre-drawing of the strap. In the case of the device described here, the pre-drawing can range from 0 to 300% and produces a winding tension between 1 daN and 100 daN.

The strap BX is preferably made from a weldable material such as a LDPE film of thickness between 7 and 40 μm. The width of the strap can usefully be between 230 and 500 mm and is preferably smaller than or equal to the length of the downstream ends 431 and 441 of the packing conveyors. Choosing a recyclable material also improves the economics of this type of packaging.

The helical movement of the strap is obtained by a combination of the longitudinal advance of the packing conveyors 430, 431 and 440, and the winding speed of the strap. The pitch P (see detail insert of FIG. 18) of the helix can be adjusted throughout the movement of the tyre batch along the packing station.

The clearing station 500 comprises a clearing conveyor 530. It can be seen that this conveyor has two lowered sections 510 and 511. The gaps left by these sections are intended to receive the forks of an ordinary fork-lift truck, to enable the removal of the packaged batch of tyres. Thus, their longitudinal extension is adjusted to receive most forks of the conventional trucks used in tyre storage depots.

The remainder of the description aims to illustrate the main phases of the process of using the device described in the present case, and refers to FIGS. 2 to 21.

Figure 2:
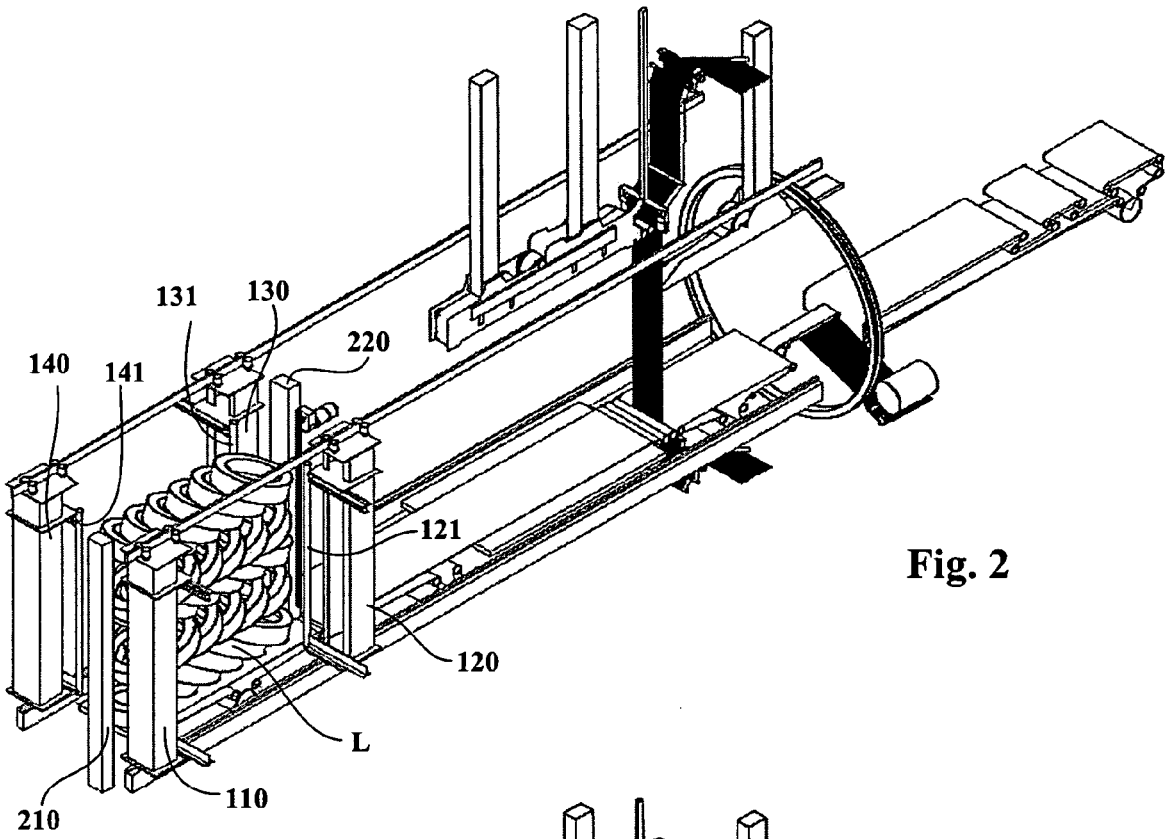
FIGS. 2 to 19: Schematic perspective views of the successive movements of the various elements of the device, at each of the main phases of its operation

When the batch L of tyres to be packaged has been made up, the posts 110, 120, 130 and 140 of the transfer device are positioned in pairs at the two longitudinal ends of the batch L, as shown in FIG. 2. The tyres are held in place by the posts 210 and 220 which delimit the overall batch size and between which they have been arranged. The holding bars 111 (not visible), 121, 131 and 141 are placed in a transversely withdrawn position to allow the transfer posts to move along the tyre batch.

Figure 3:
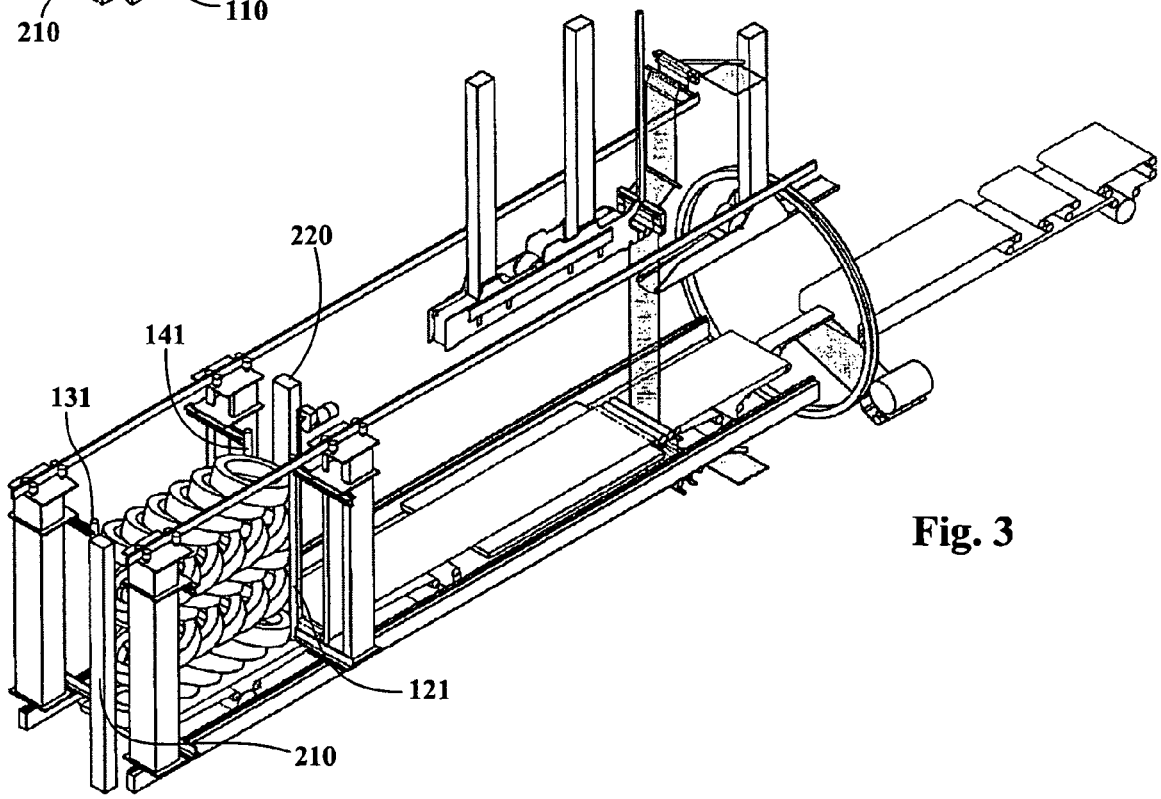

When the transfer posts are in place, the holding bars 111, 121, 131 and 141 are moved transversely so as to come in contact with the tyres of the batch L, as shown in FIG. 3. The position of the bars is judiciously chosen so as to ensure that the batch is held in the transverse and longitudinal directions during the movements of the batch from one station to another. The posts 210 and 211 defining its overall size are kept in place.

Figure 4:
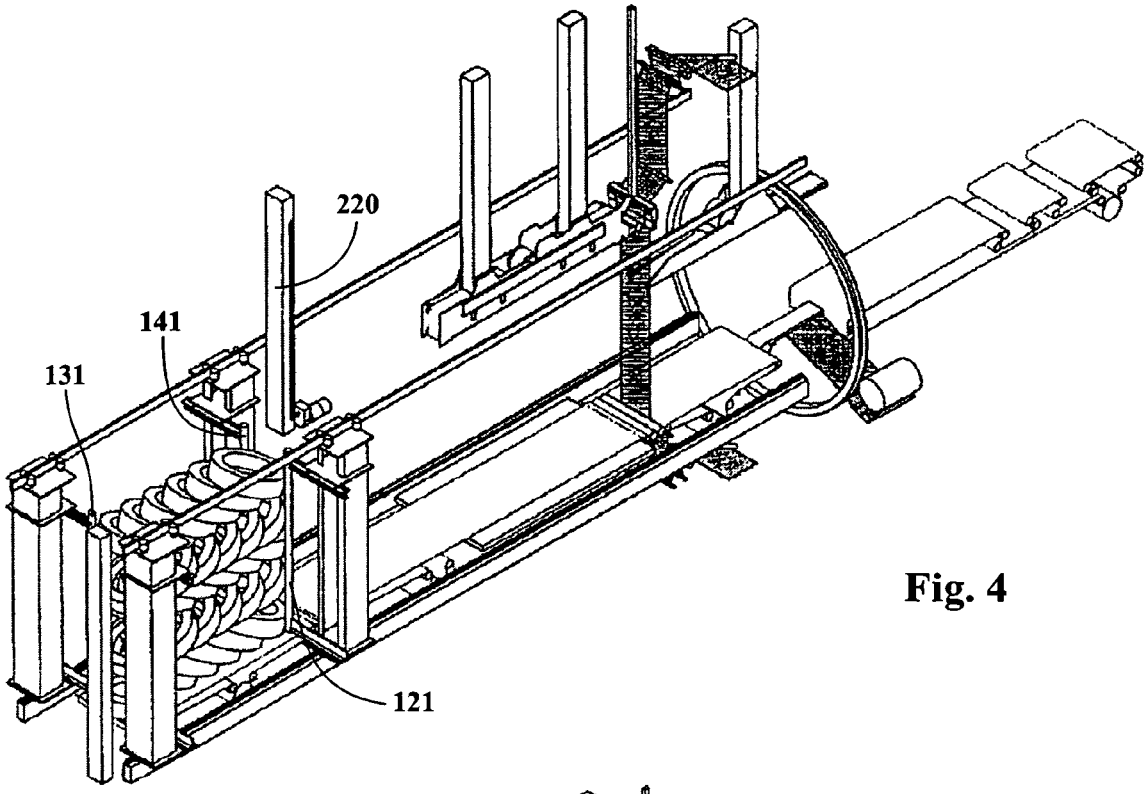

The next phase is illustrated in FIG. 4. During this, the downstream size post 220 is moved longitudinally in the upstream direction of the device and then raised vertically to allow the batch free passage in the longitudinal direction. At that moment the batch is only held by the holding bars 111 (not visible), 121, 131, 141 of the transfer assembly.

Figure 5:
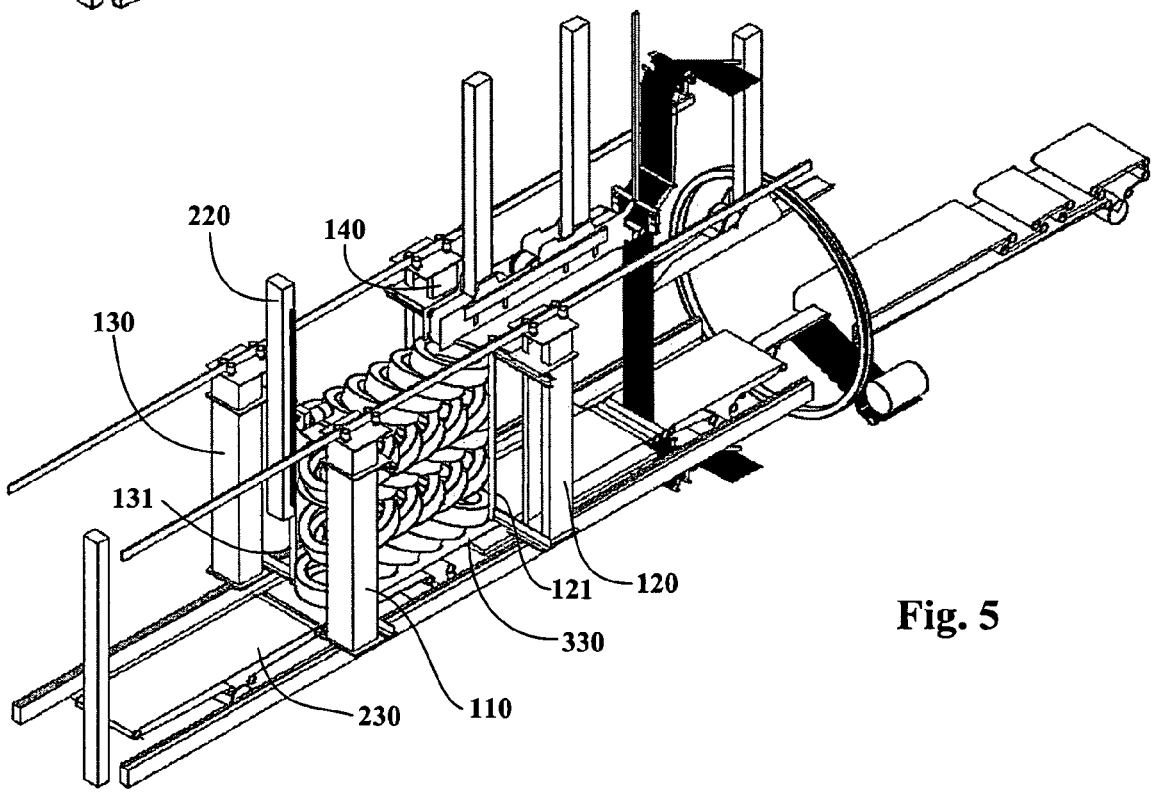

By simultaneous and synchronised actuation of the pre-packaging station conveyer 230, the conveyor of the compression station 330 and the transfer posts 110, 120, 130 and 140, the batch L is moved longitudinally downstream from the pre-packaging station towards the compression station, as illustrated in FIG. 5. The tyre batch is held by the holding bars 111 (not visible), 121, 131 and 141 (not visible).

Figure 6:
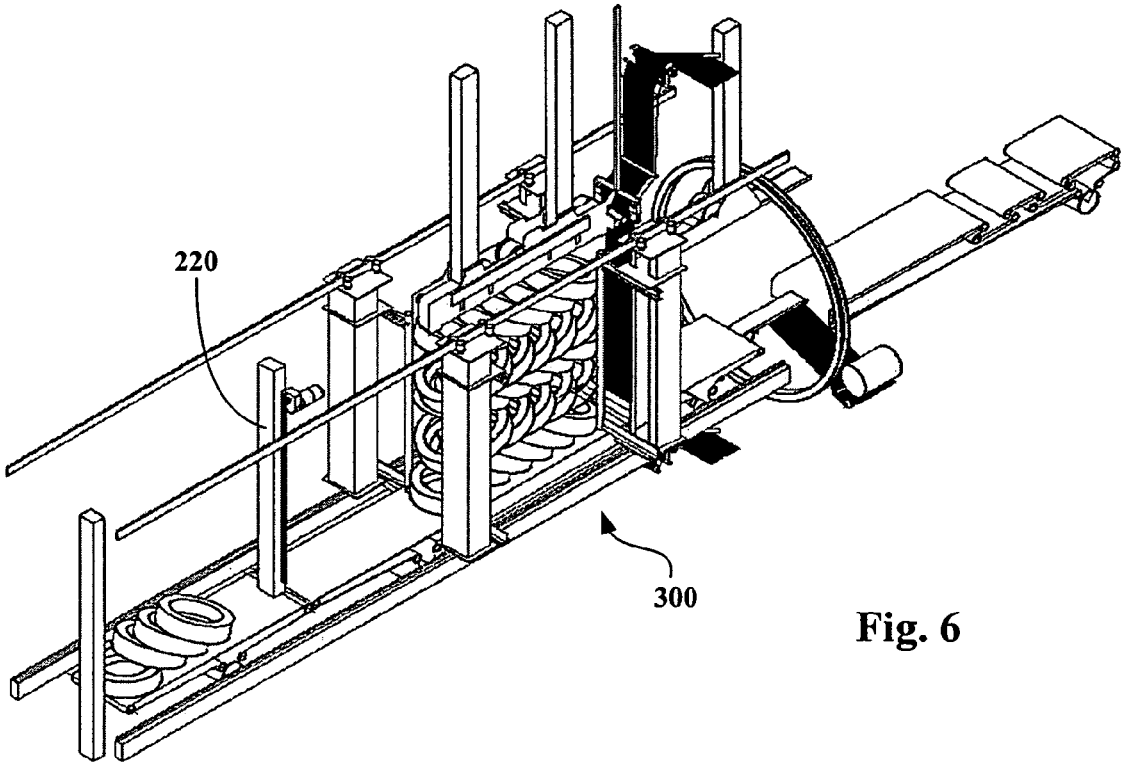

The size post 220 is then lowered into position again to enable the next batch to be made up, and the batch L is placed in position at the compression station 300, as shown in FIG. 6.

Figure 7:
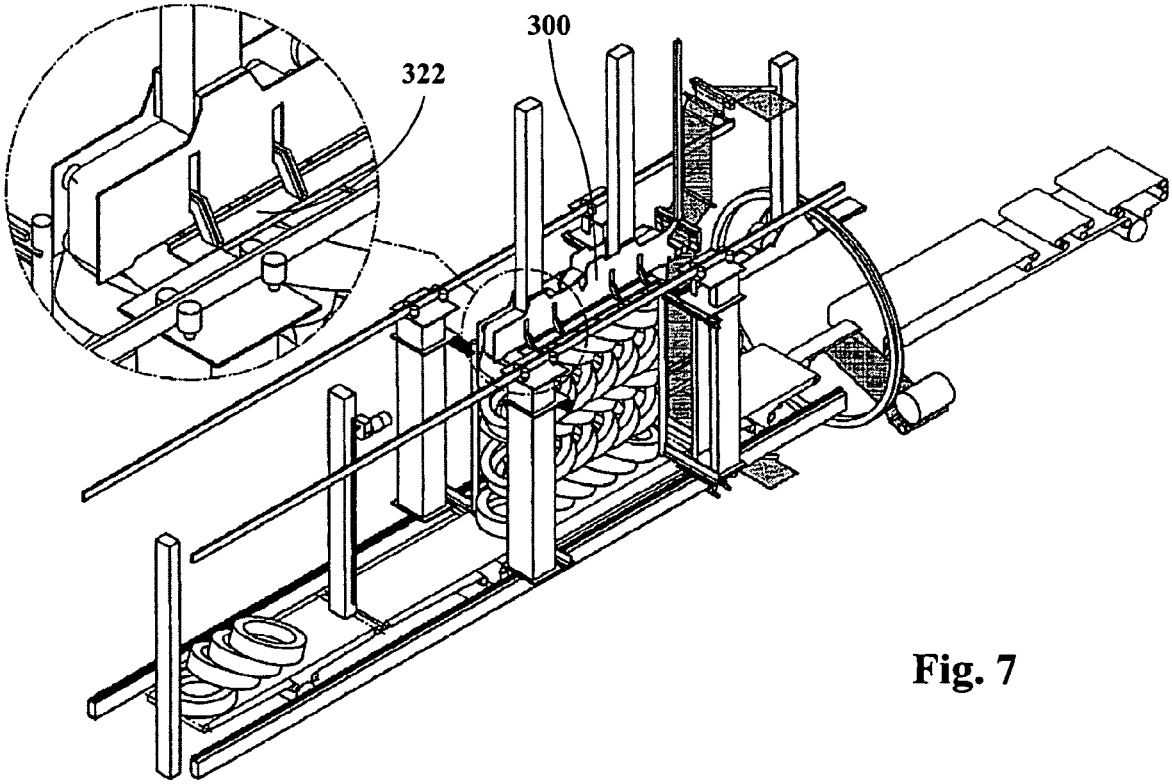

Depending on the width of the tyre batch, the retractable flaps 322 and 323 (not visible) are lowered, as shown in the insert of FIG. 7. As mentioned earlier, these flaps can be particularly useful when tyres of large diameter are to be packaged, but also when the tyres are arranged in two longitudinal rows.

Figure 8:
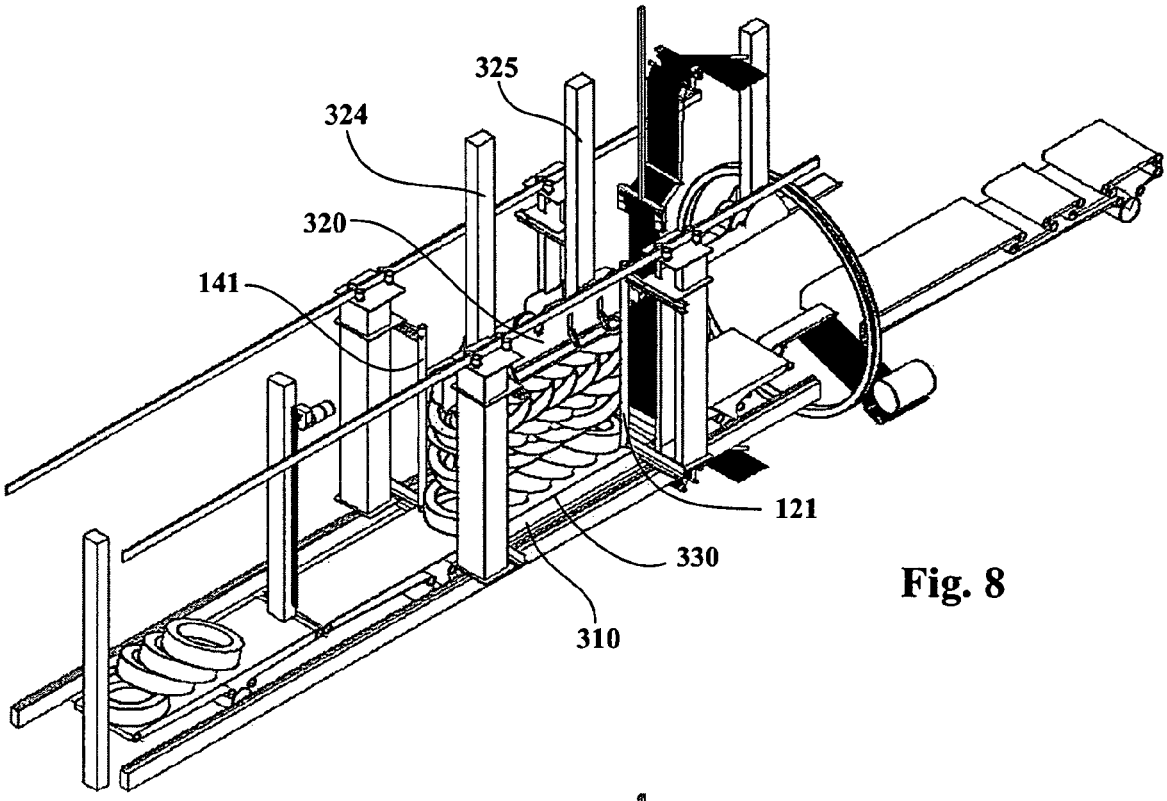

FIG. 8 illustrates the phase in which the tyres are compressed vertically, in the direction perpendicular to the plane of the layers. The columns 324 and 325 are lowered so as to compress the batch between the upper compression plate 320 and the lower compression plate 330. The tyre batch is still held by the holding bars 111 (not visible), 121, 131 (not visible) and 141 of the transfer assembly.

During this phase the vibratory table 310 is actuated, the effect of this being to assist the mutual overlapping of the tyres and to increase the internal cohesion of the batch once the packaging has been done. The degree of compression can be as much as 60% of the height of the batch as it was before compression. In practice, the compression is more like 30%.

To perfect the positioning of the tyres it is also possible to compress them to an extent slightly greater than the final compression level, and then relax the compression by a predetermined amount to reach the final compression level desired.

Figure 9:
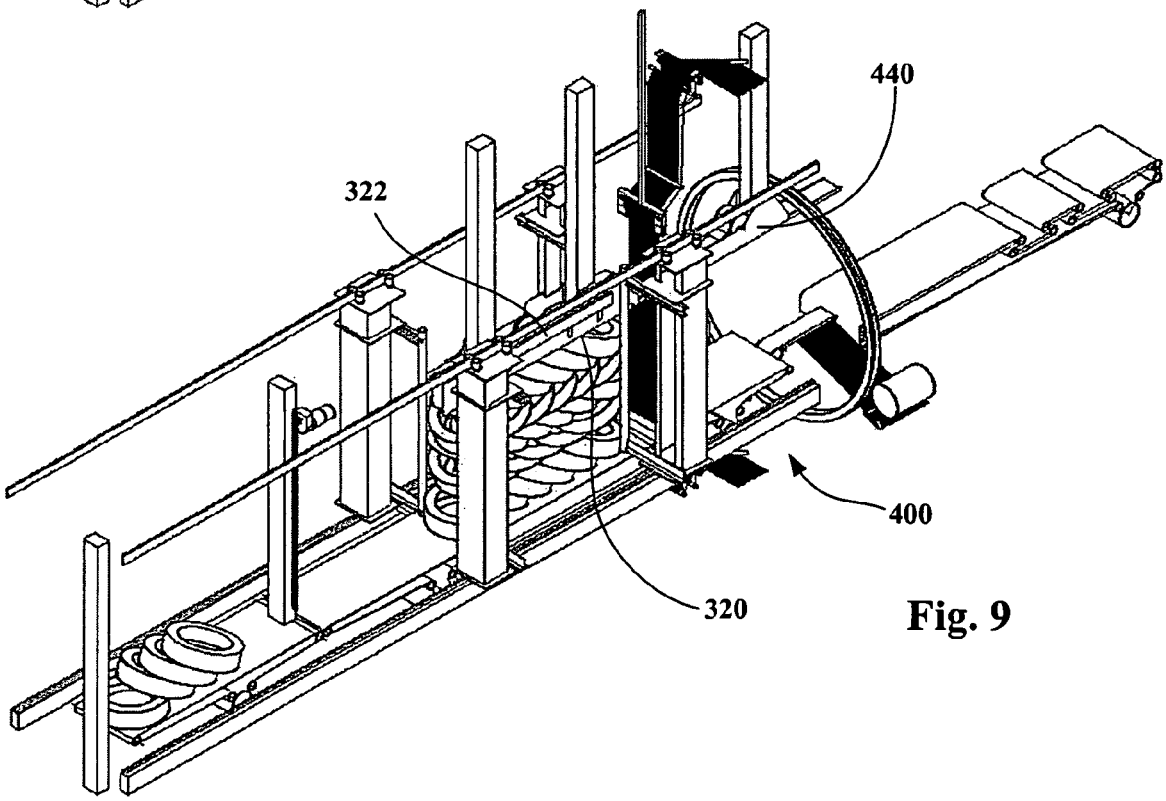

Once the desired compression has been achieved, the retractable flaps 322 and 323 (not visible) are raised as shown in FIG. 9, and the batch is ready to be transferred to the packing unit 400. The upper packing conveyor 440 is positioned vertically at the same height as the upper compression plate 320, so as to keep the batch in the same state of compression during the wrapping phase.

Figure 10:
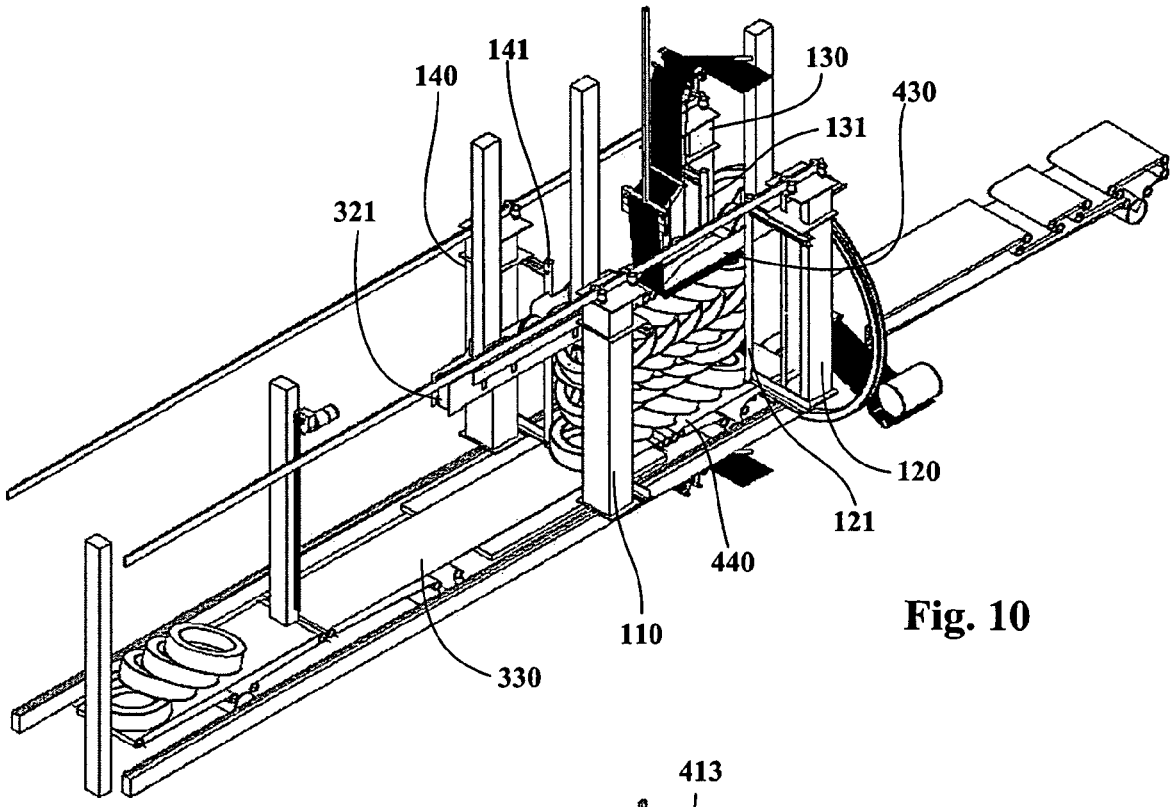

As shown in FIG. 10, the synchronised and simultaneous advance of the conveyors 321 and 330 located on the upper and lower compression plates, the packing conveyors 430 and 440 and the transfer posts 110, 120, 130, 140 supporting the holding bars 111 (not visible), 121, 131 and 141, moves the batch L in the downstream direction of the device.

On arriving in front of the curtain formed by the straps BY0 and BY1 of the stretch-wrapping bundler 410, the batch L draws the tensioned strap between the rollers 412 and 413. The strap thus lies in tension against the front face, and is then laid simultaneously over the upper and lower faces of the batch as the batch L continues its advance.

Figure 11:
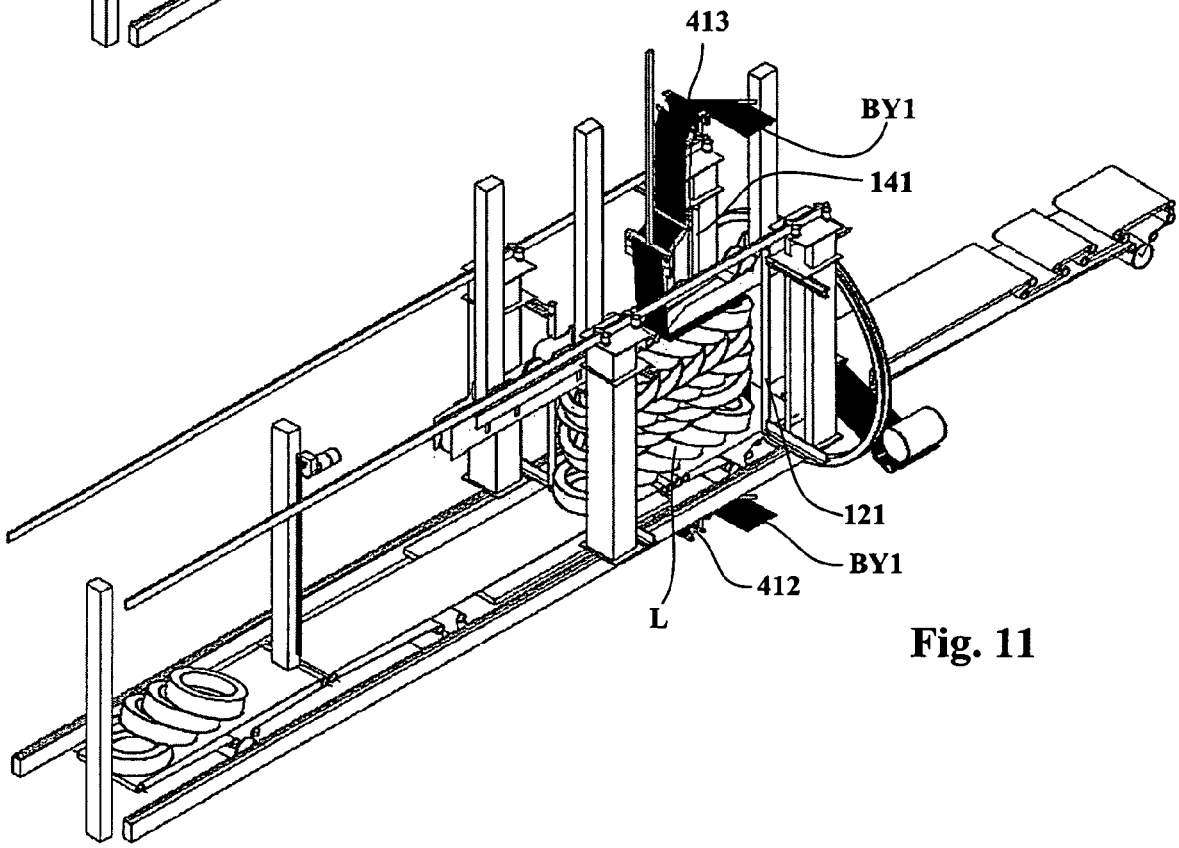
Figure 12:
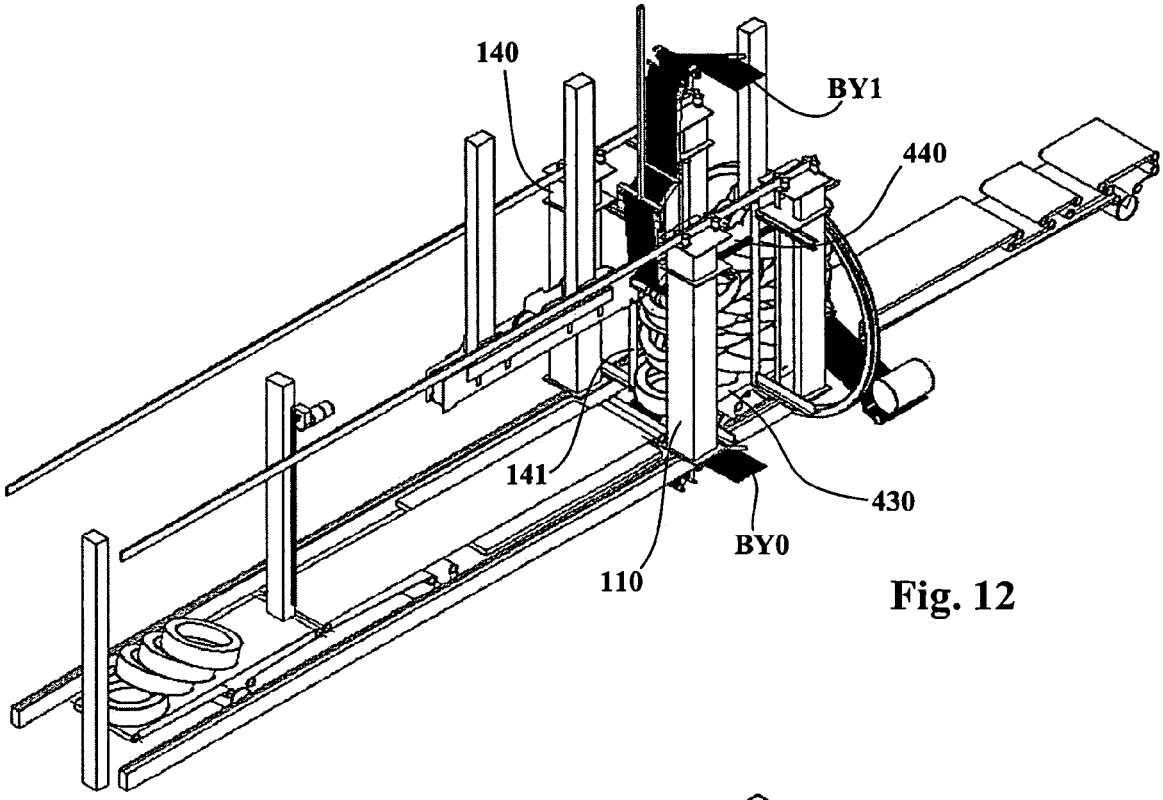

Once the strap is covering the front part of the batch L, it becomes possible to withdraw the holding bars 121 and 141, which are retracted transversely to a rest position as shown in FIG. 11.

FIGS. 12, 13, 14 and 15 illustrate the final phase of the positioning of the strap in the transverse axis YY'. The batch L continues its downstream movement in the device, still held by the downstream holding bars 111 (not visible) and 131 and by the packing conveyors 430 and 440, until the straps BY0 and BY1 totally cover the upper and lower parts of the said batch L. The feed spools 411 and 412 of the straps BY0 and BY1 deliver the required length of strap.

Figure 13:
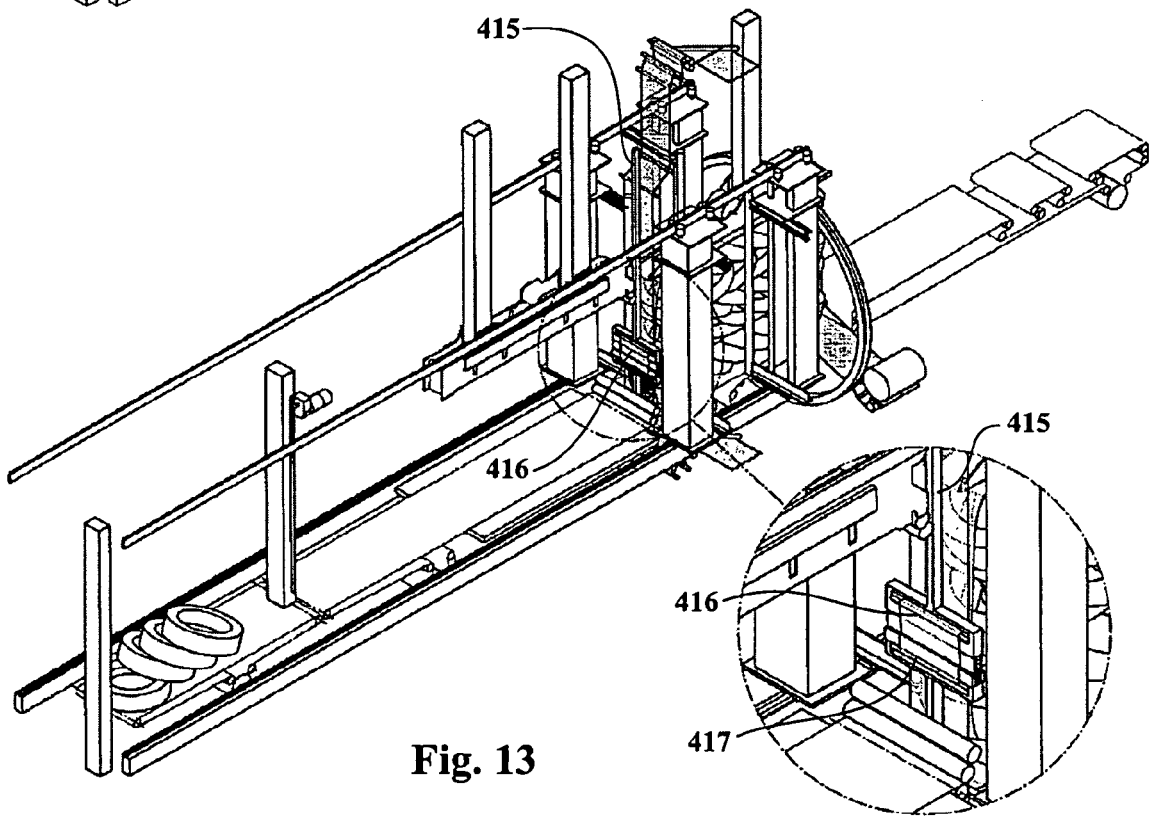
Figure 14:
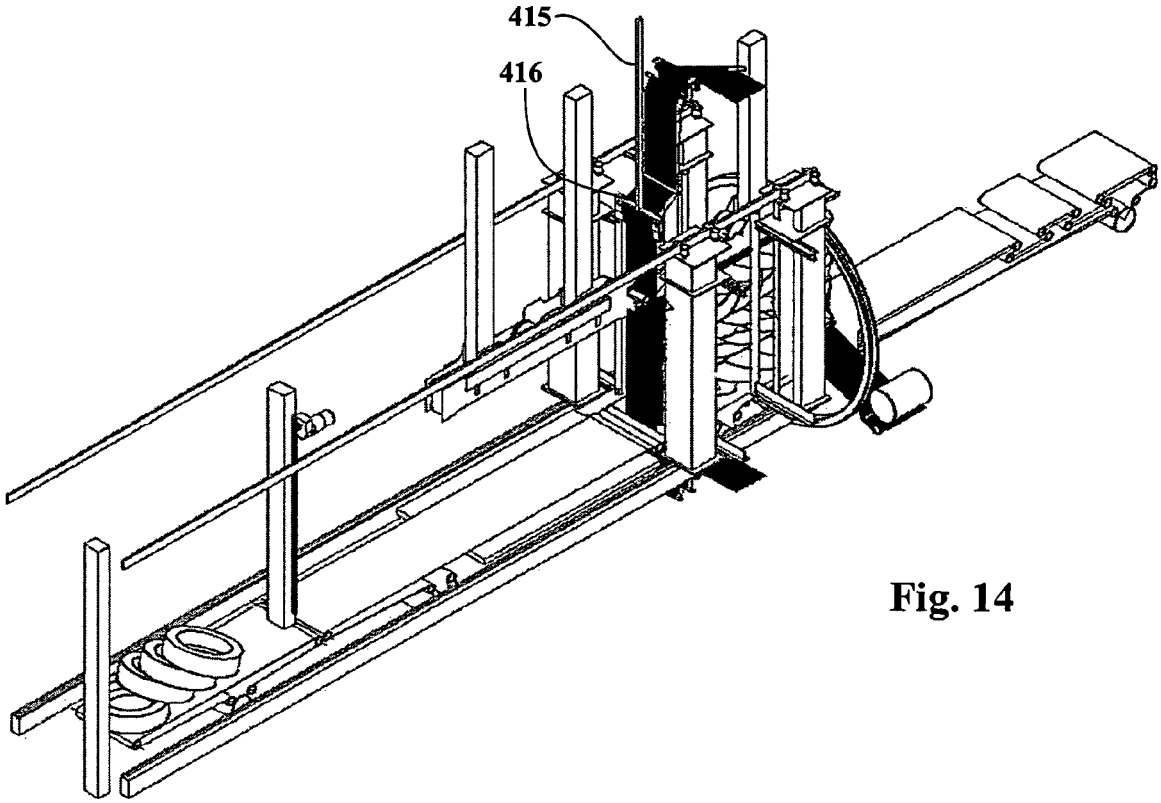

At this stage the upper jaw 416 supported by the post 415 meets the lower welding jaw 417, the effect of which is to close up the curtain and put it under tension over the front, downstream face of the batch, so as to form a continuous wrapping around the said batch, as illustrated in the insert of FIG. 13. A first weld enables the curtain to be closed. The blades (not shown) integrated in the welding unit separate the curtain wrapping by simply cutting it. A second weld enables the seam S of the curtain intended for wrapping the next batch to be reconstituted. The upper jaw 416 is then returned to its high position, as shown in FIG. 14.

It is quite possible to use the same stretch-wrapping bundler to position a second and a third wrapping, by moving the tyre batch in the upstream direction and then again in the downstream direction, so that at each movement it passes through the curtain formed by the straps BY0 and BY1, and repeating the operations of welding and cutting as described in the previous paragraph.

Figure 15:
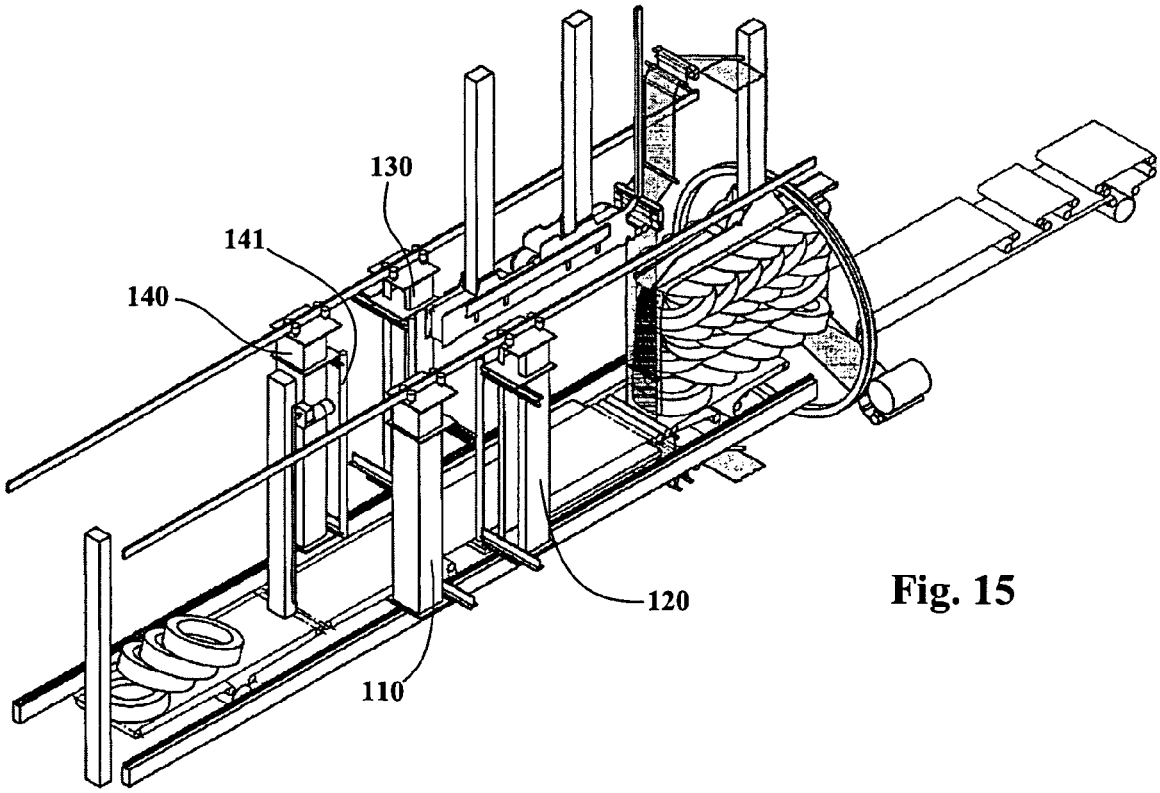

The forces exerted by the wrapping and the two packing conveyors are sufficient to hold the batch L. This enables the holding by the transfer assembly to be released. The holding bars 111 (not visible) and 131 are withdrawn in the transverse direction, and the four posts 110, 120, 130 and 140 are returned to the waiting position, as shown in FIG. 15.

FIGS. 16 to 19 illustrate the positioning of the strap BX by the strap winding machine 420. At this implementation stage of the process, the batch of tyres is held entirely by the two packing conveyors 430 and 440 and by the wrapping positioned earlier.

Figure 16:
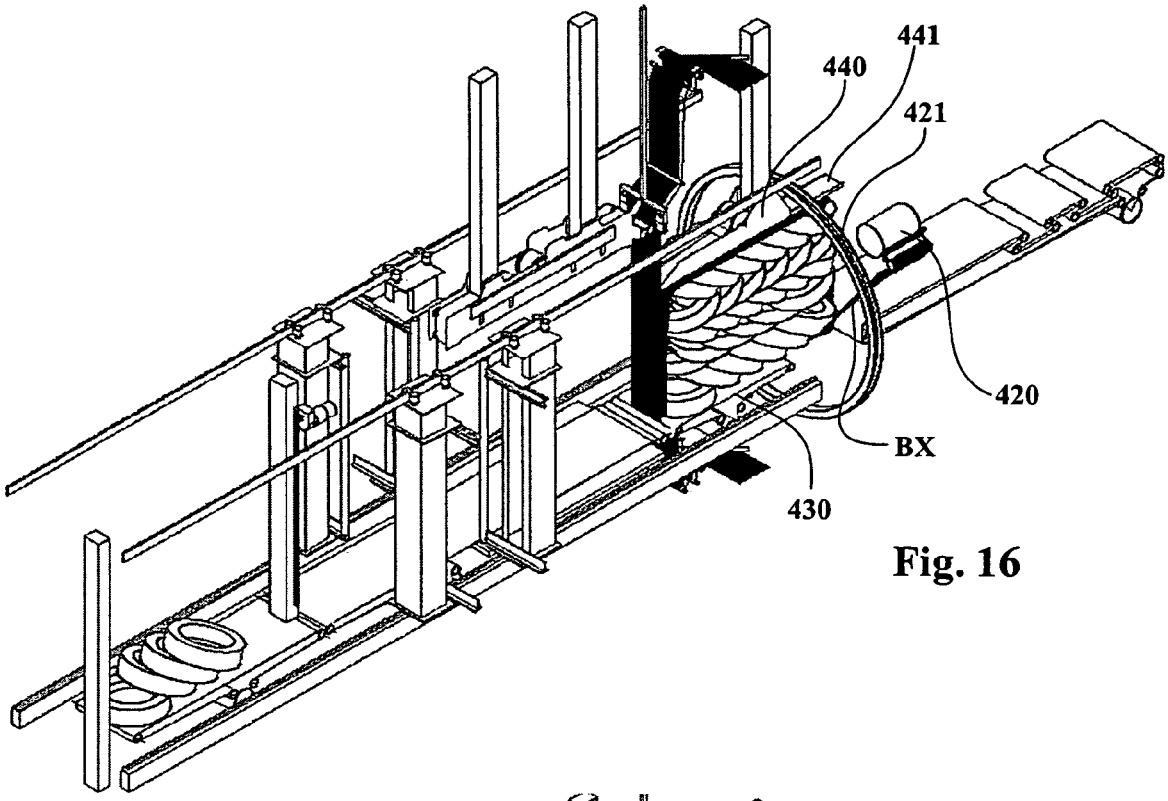
Figure 17:
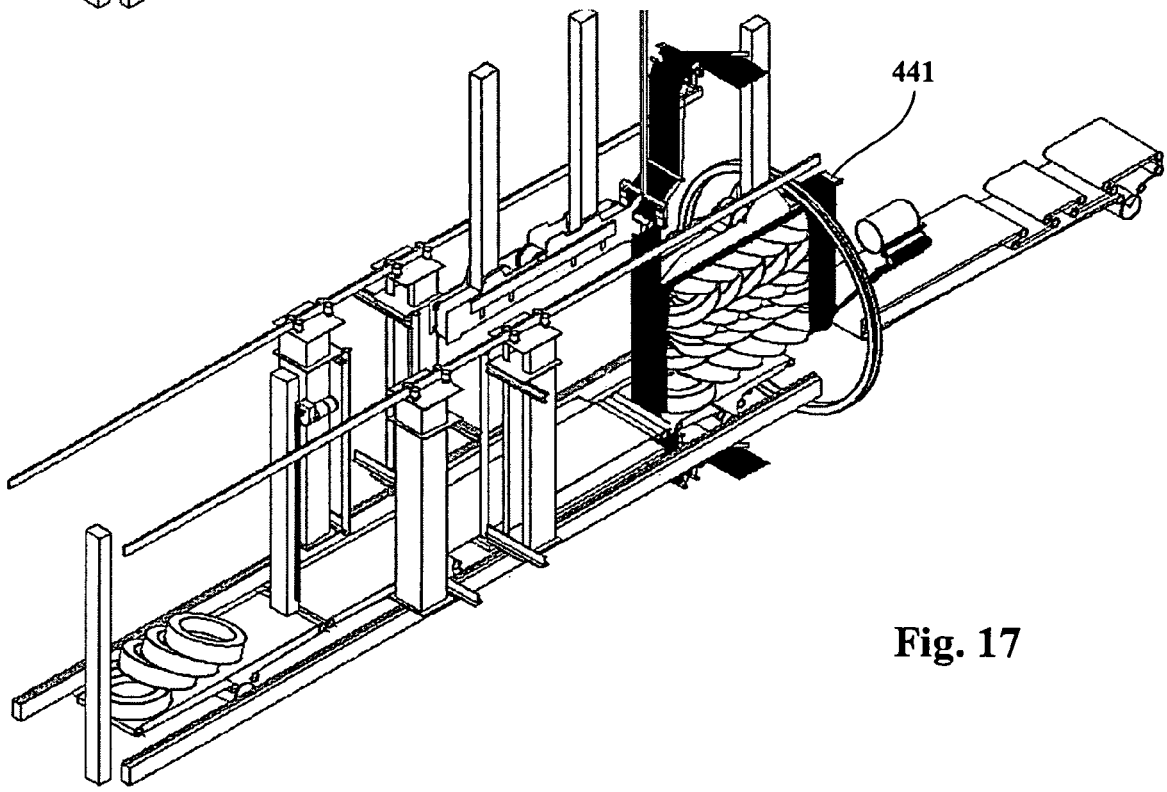

The strap winding machine guided by the circular rail 421 rotates around the assembly formed by the tyre batch and the downstream portions 431 (not visible) and 441 of the packing conveyors, as shown in FIG. 16. Note that the strap BX encloses the said downstream ends of the conveyors, as shown in FIG. 17.

Figure 18:
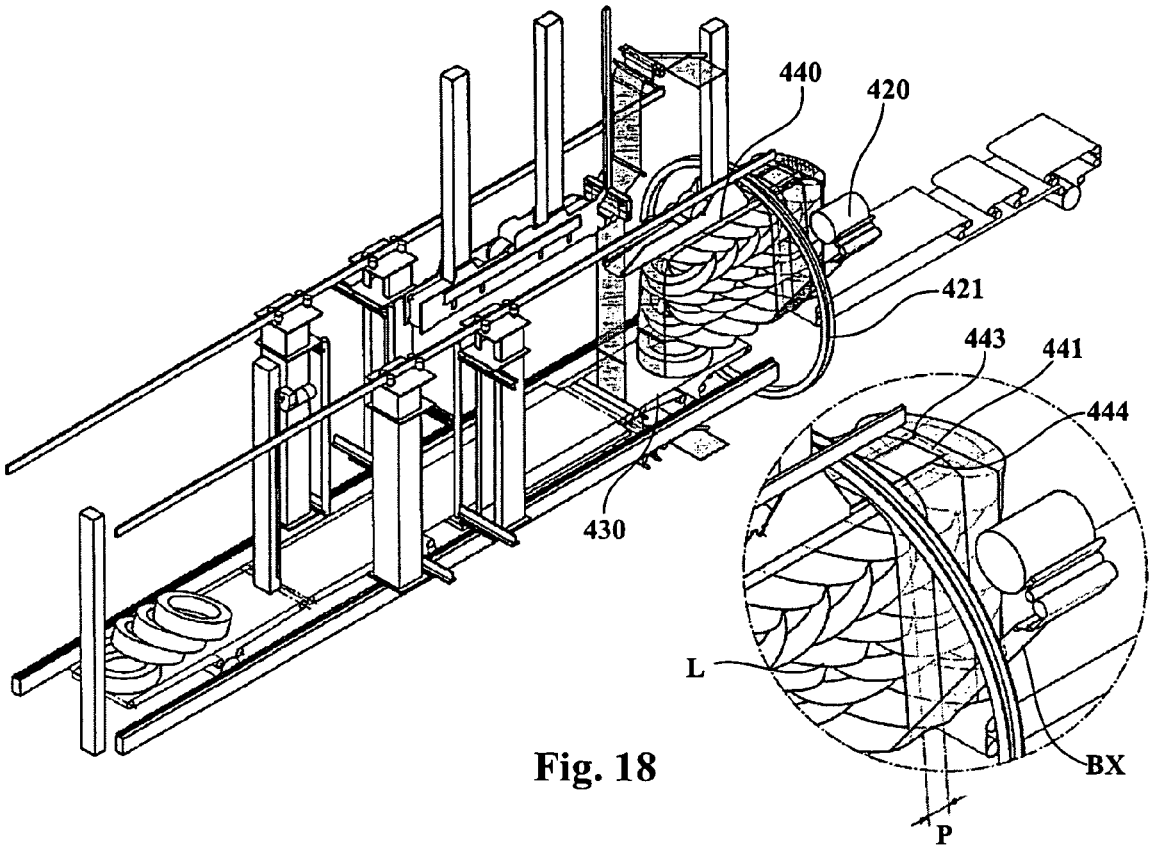

As illustrated by the detail insert of FIG. 18, the pitch P of the helical winding around the tyre batch L is determined by adjusting the direction and longitudinal speed of the packing conveyors 430 and 440 or the rotation speed of the strap winding machine 420 around the guide rail 421. Thus, the pitch P is adjustable throughout the strap winding phase, and can be determined as a function of the nature of the stresses to be undergone by the batch L, once packaged, during handling operations. It may be positive or negative depending on the movement direction of the packing conveyors, and can also be zero, or locally larger than the width of the strap BX. As a general rule the pitch P is chosen such that the straps BX overlap over part of their width.

The pitch P is determined experimentally as a function of the mass and number of tyres making up the batch, the size of the batch and the tensile strength of the strap BX, such that once packaged, the batch will not expand by more than 2% of its height when compressed between the compression plates 320 and 330 or between the packing conveyors 430 and 440. In practice the degree of expansion is less than 1%. Particular care is taken to reduce the pitch in areas that undergo the largest longitudinal forces during handling by a fork-lift truck, the said forces being located in the upper central areas and at the longitudinal ends of the tyre batch, as can be demonstrated by a quick calculation of stresses.

It can also be seen that the strap BX is applied over the two upper edges of the shoulders 443 and 444 of the downstream end 441 of the upper conveyor, as also shown in the detail insert of FIG. 18. The same applies to the shoulders at the downstream end 431 of the conveyor 430, not visible in the perspective view of FIG. 18. As the batch L moves forward, the strap BX slips over the said edges and this allows disengagement of the said downstream parts 431 and 441 of the packing conveyors from the space between the strap and the upper and lower surfaces of the tyres. By virtue of the tension and pre-drawing, the strap then presses against the back of the tyres located perpendicularly in line at the top and bottom surfaces of the tyre batch.

Figure 19:
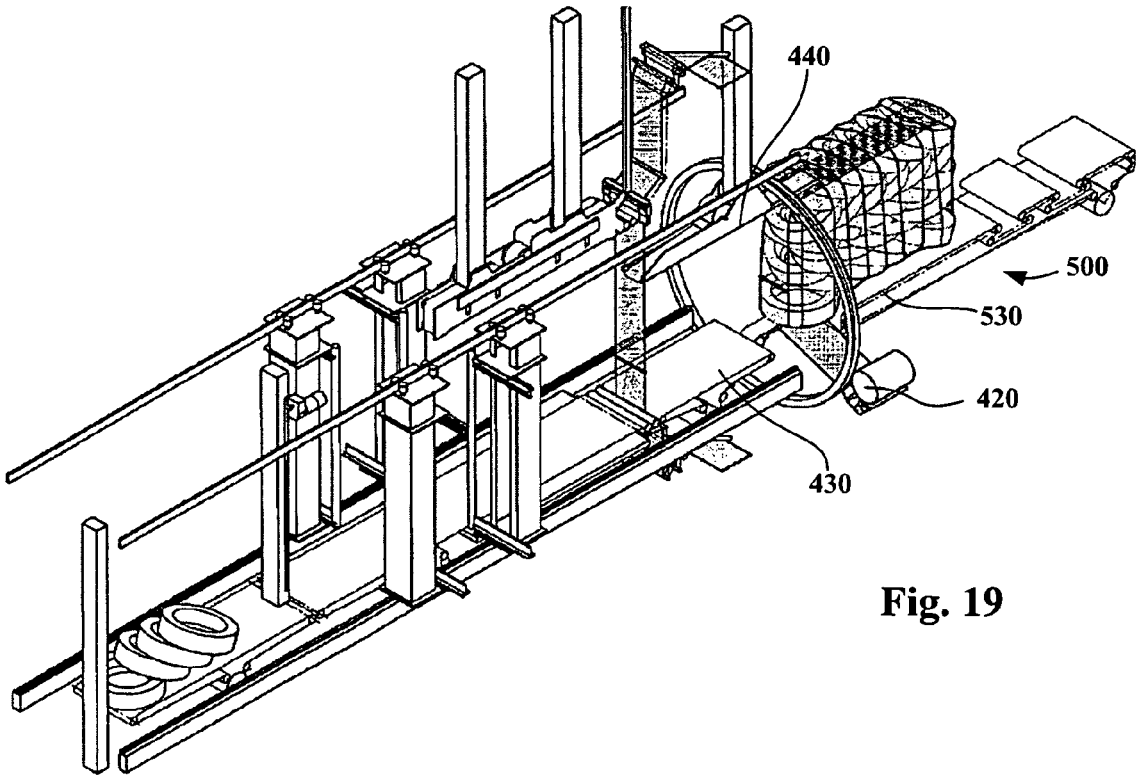

As it moves, the batch disengages progressively from the packing conveyors 430 and 440 and only the part thereof around which the strap BX has not yet been wound remains held in compression by the said packing conveyors. The batch is then moved towards the conveyor 530 of the clearing station 500, which is then set in motion synchronously with the packing conveyors as shown in FIG. 19. Once the packing operation has been completed, the strap BX is separated from the tyre batch L and the end of the strap remaining on the batch L is fixed in position by being welded to itself, by a welding device familiar to those with knowledge of the subject, and therefore not shown. The packaging device is then once more in the configuration shown in FIG. 1.

At this stage the batch constitutes a homogeneous unit with sufficient structural strength to be able to be taken up by the forks of a conventional fork-lift truck, without any need for a supporting surface such as a flat pallet or even a cardboard-covered pallet.

FIGS. 20 to 24 describe a particular way of carrying out the strap winding operation. In the current embodiment, the downstream part of the lower packing conveyor 431 is kept horizontal in line with the plane of the packing conveyor 430, as shown in FIG. 20.

Consequently, once the wrapping has been done, the lower surface of the batch is essentially parallel to the plane on which the said batch is resting. This arrangement does not create any major problems for the clearing of the batches L from the device, because of the presence of the lowered portions 510 and 511 in the conveyor 530 of the clearing station 500. A difficulty may nevertheless arise when the batch is then deposited on flat ground and has to be taken up again by the forks of a conventional fork-lift truck. In effect it is difficult to slide the forks under the batch in order to move it elsewhere, without damaging the straps or the tyres.

A particular design of the stretch-wrapping process enables this difficulty to be overcome. For this, referring to FIGS. 21 to 23 it suffices to tilt the conveyor 431 a few degrees upwards by pivoting it about its axis, which as mentioned earlier is essentially parallel to the YY' direction, to produce an additional compression of the batch by a height E at a centred position of its base. This deformation E is preserved permanently by the strip BX once the latter has been wound around the batch L, as shown in FIGS. 22 and 23. The height E can range from 0 to 15 cm and the additional compression force can amount to 750 daN.

At the beginning and end of the strap-winding operation the conveyor 431 is kept horizontal so that the bottom of the batch adopts a concave shape. The batch then rests on the tyres arranged at its base, at its two longitudinal ends, as shown in FIGS. 20 and 24. The central portion of the batch is no longer in contact with the surface on which the batch L is resting, and it is then easy to introduce the forks of the fork-lift truck into that space.

FIGS. 25 to 30 show artist's sketches of the various alternative tyre batch packages that can be produced with the device, which have been mentioned in this description.

Figure 25:
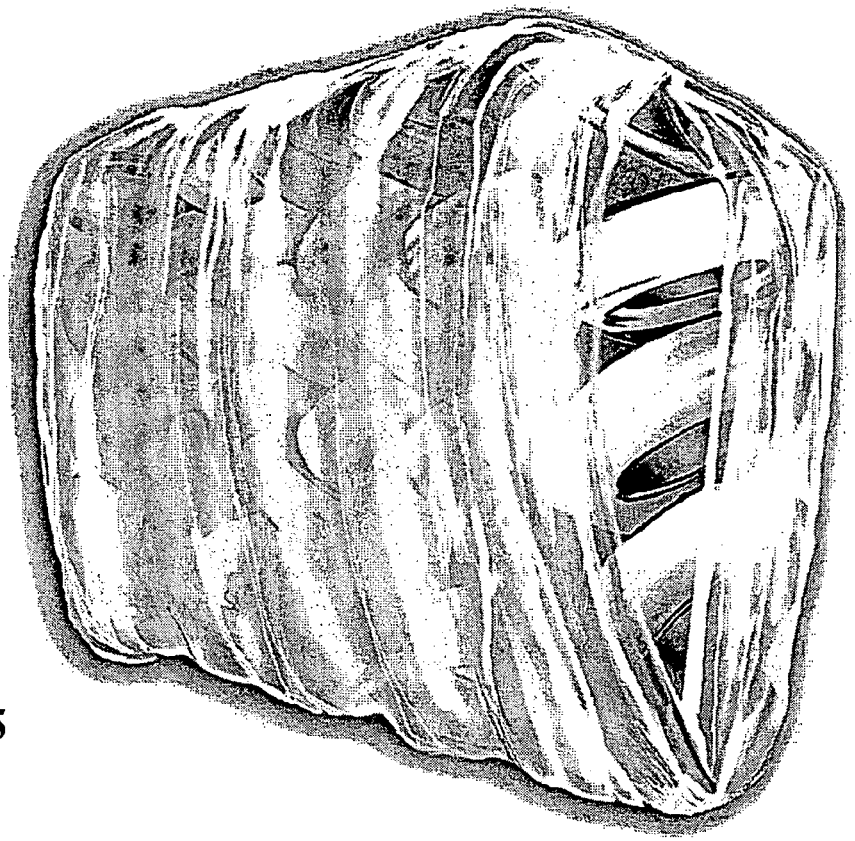
FIGS. 25 to 31: Schematic perspective views of the tyre batches that can be produced by the device of the invention
Figure 26:
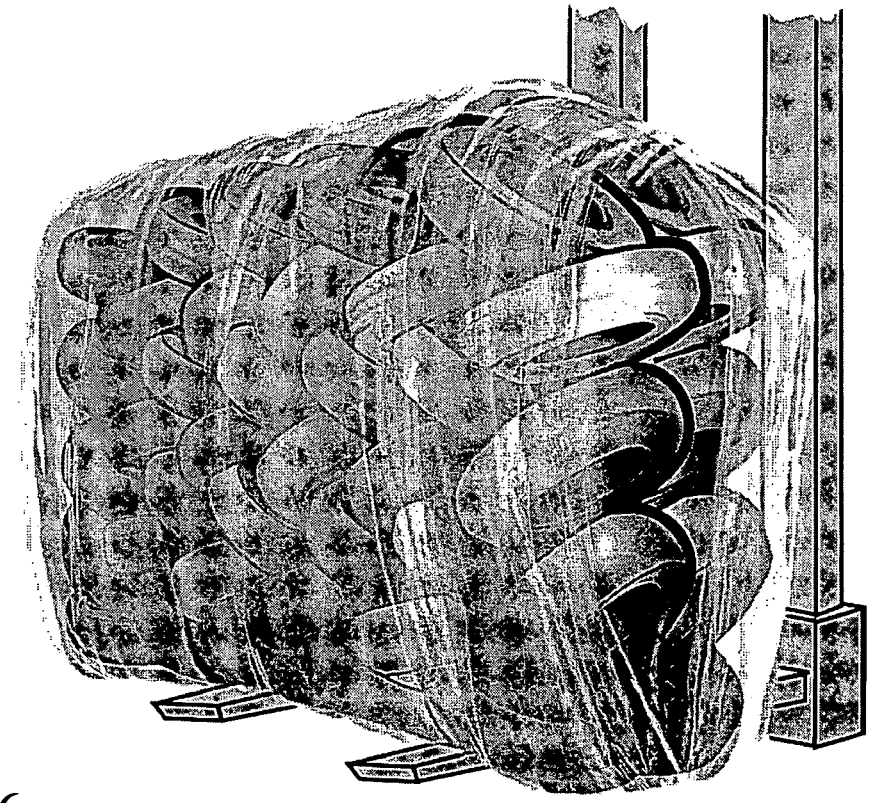

Thus, FIG. 25 depicts a packed batch formed of a single row of tyres with a substantially flat base. FIG. 26 shown a batch formed by two rows of tyres.

Figure 27:
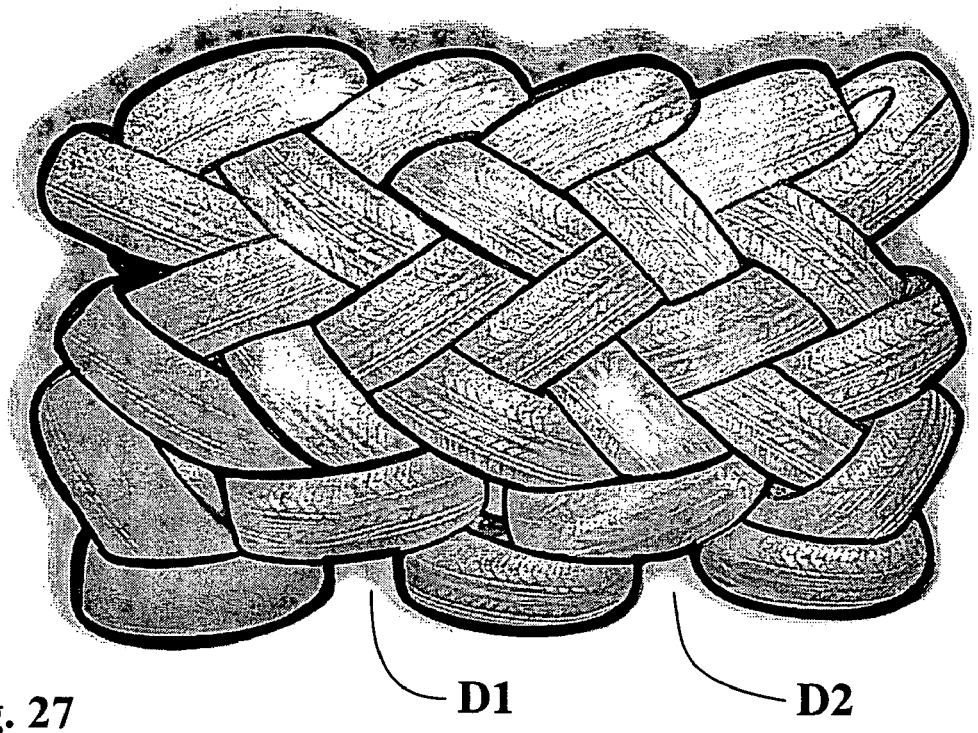
Figure 28:
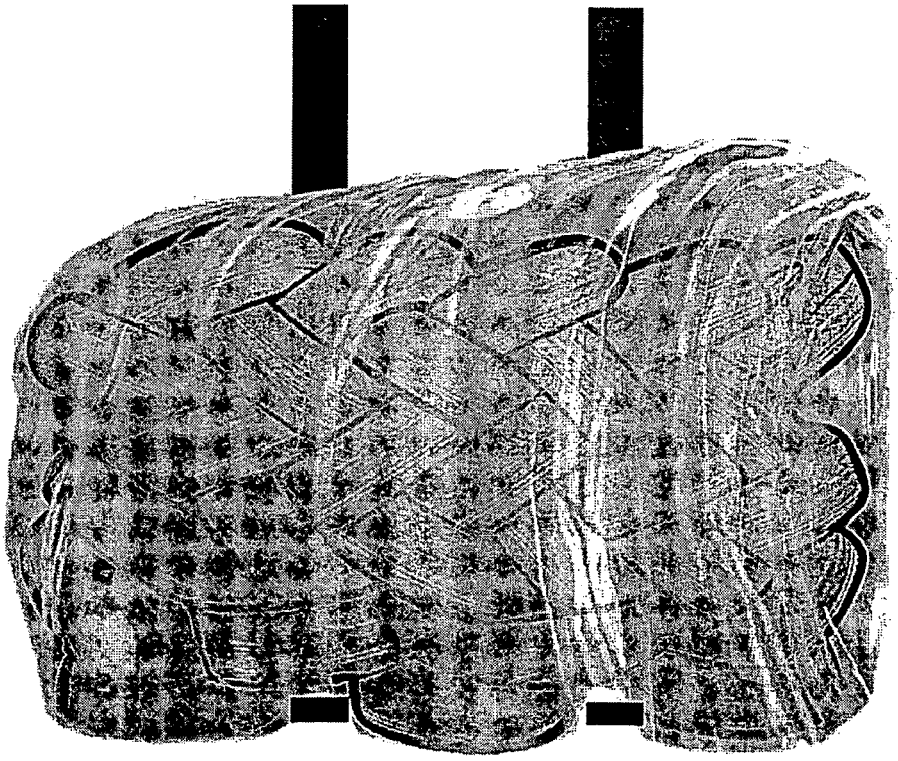

FIGS. 27 and 28 show an alternative batch configuration, in which the tyres forming the first layer are arranged so as to produce two recesses D1 and D2 the same distance apart as are the forks of a conventional fork-lift truck. By virtue of its application tensions the strap BX substantially conforms to the shape of these recesses and it is therefore easy to introduce the forks of a fork-lift truck.

Figure 29:
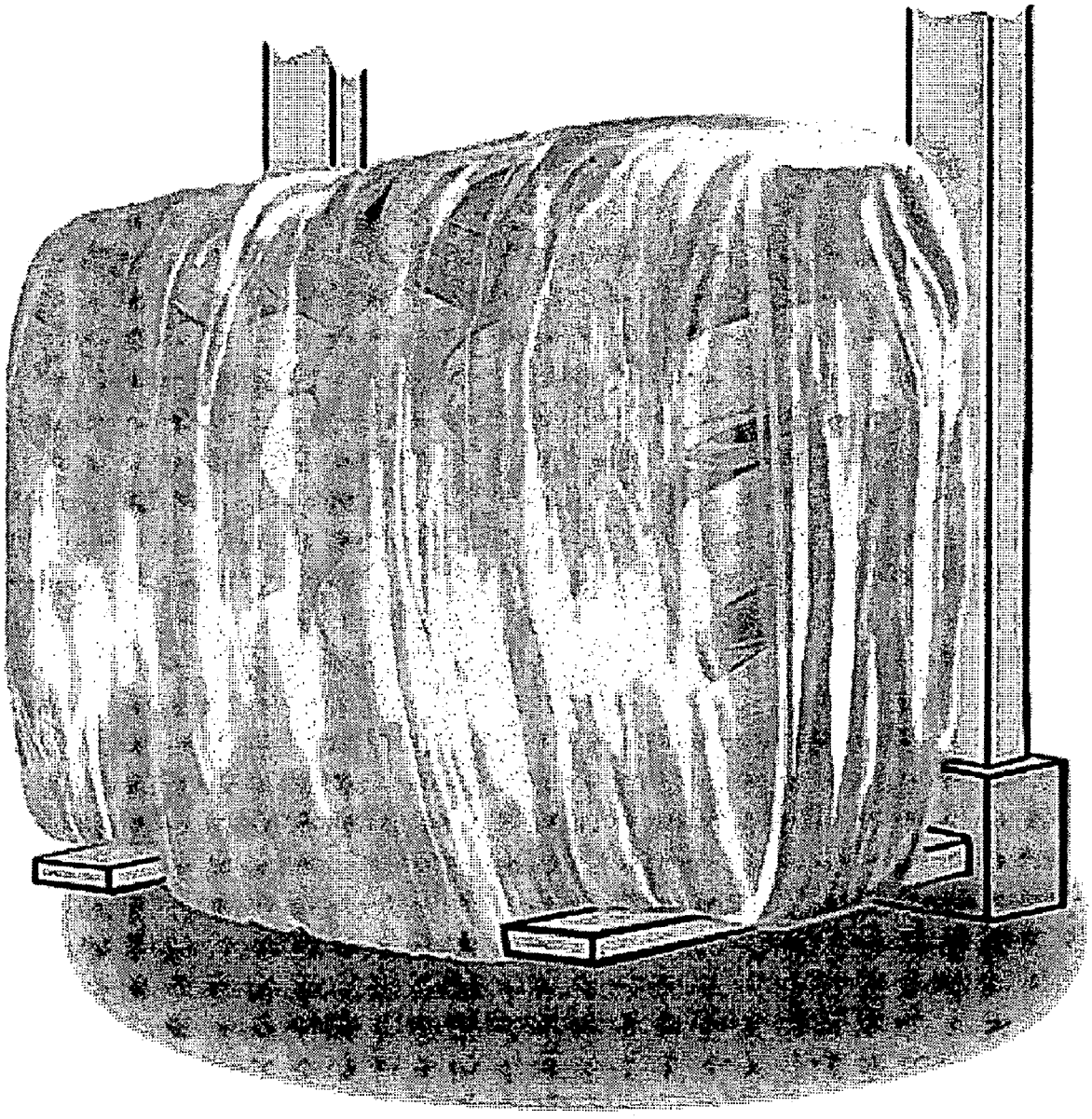

FIG. 29 shows a tyre batch in which the recesses D1 and D2 that allow the introduction of the forks of the fork-lift truck under the tyre batch L are located at the two longitudinal ends of the batch.

The configurations of the batches shown in FIGS. 27, 28 and 29 are obtained while making up the batch of tyres L at the pre-packaging station. The recesses D1 and D2 can be formed during the formation of the first layer of tyres, or preferably during the formation of the last layer.

In effect, it has been observed that this second option has the advantage of conferring greater structural stability on the batch L when packaging has been completed. It is then necessary to turn the batch over around its longitudinal axis so that the recesses D1 and D2 are at the bottom, in order to be able to introduce the forks of a fork-lift truck and remove the batch.

Figure 30:
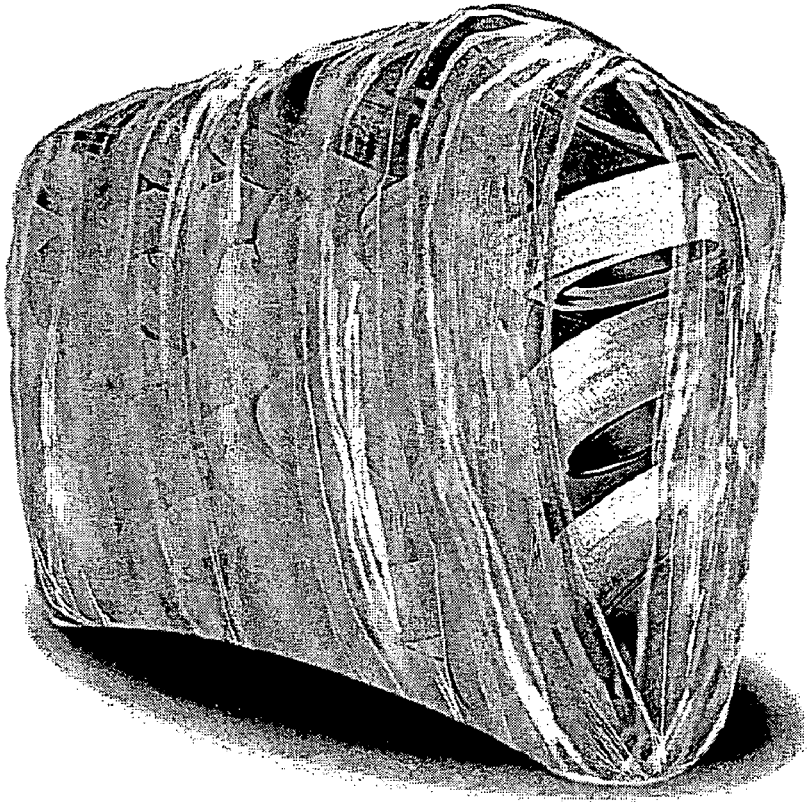
Figure 31:
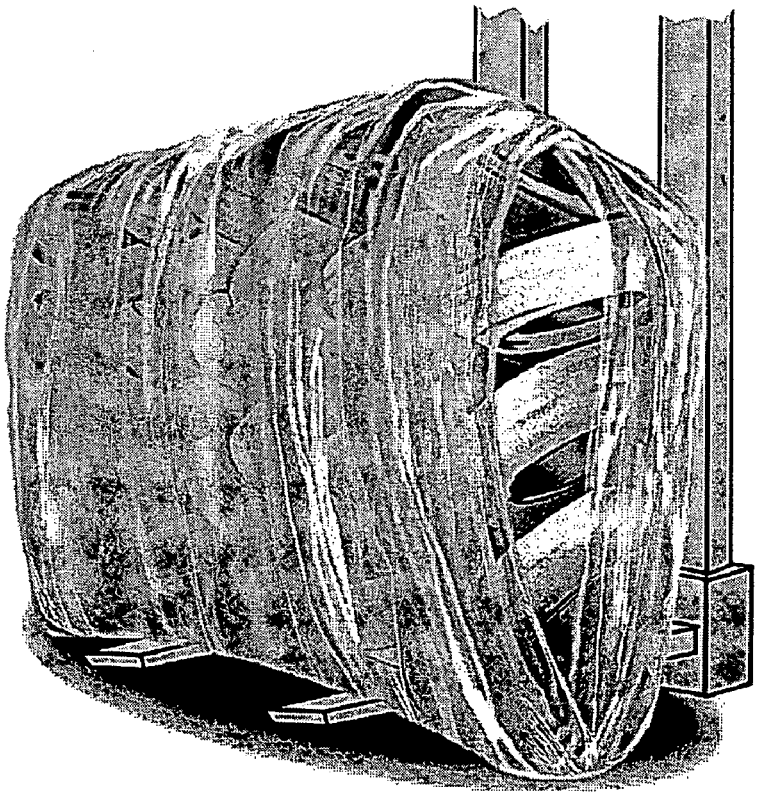

FIGS. 30 and 31 show a batch comprising a single row of tyres, whose base has been subjected in the middle to additional compression so that it has a concave shape which allows the introduction of the forks of a fork-lift truck.

The device described here enables a large number of variants of packaged tyre batches to be produced. Thus, the positioning of a strap along the axial orientations claimed is particularly easy to achieve.

Finally, all the tyre batches enable the handling expected in a storage depot to be carried out easily, since no recourse to supplementary packaging means is necessary. They can be manipulated directly with the help of a fork-lift truck, and form logistical units suitable both for transport and for storage in depots, thereby avoiding handling operations necessitated by packaging changes.

The invention claimed is:

1. Apparatus for packaging tyres, comprising:

a compression station arranged for receiving a plurality of tyres arranged in horizontal layers to form a tyre batch extending along a generally horizontal first direction, the compression station including a compression mechanism having a pair of vertically spaced compression conveyors arranged for generally vertically compressing the tyre batch therebetween in a generally vertical second direction with a degree of compression in the range of from 15% to 60% of an original height of the tyre batch, the tyre batch being movable along the compression conveyors in the first direction while in the compressed state;

a packing station for receiving the compressed batch and including:

a strap applicator for applying, under tension, first and second straps formed of a drawable, weldable material, around the batch, the strap applicator comprising:

a pair of vertically spaced packing conveyors for receiving therebetween the compressed tyre batch moved thereto in the first direction by the compression conveyors; the packing conveyors being operable for keeping the tyre batch under said compression while receiving the tyre batch from the compression station and during the application of the first and second straps, wherein downstream portions of the packing conveyors are of smaller width than the tyre batch;

a first winder mechanism for winding the first strap around the tyre batch about a generally horizontal first axis oriented substantially perpendicular to the first direction, and a second winder mechanism for helically winding the second strap about a second axis extending substantially parallel to the first direction, wherein the second winder mechanism is arranged to encircle downstream portions of the packing conveyors and the tyre batch to wind the second strap around the tyre batch.

2. Apparatus according to claim 1, further including a pre-packaging station disposed upstream of the compression station for forming the batch of tyres.

3. Apparatus according to claim 2 wherein the pre-packaging station includes a conveyor mechanism for conveying the tyre batch in the first direction to the compression station.

4. Apparatus according to claim 1 wherein the first winder mechanism is disposed upstream of the second winder mechanism.

5. Apparatus according to claim 1 wherein the second winder mechanism is operable to vary the pitch of the second strap during winding of the second strap around a given tyre batch.

6. Apparatus according to claim 1 further comprising a transfer assembly arranged to engage the tyre batch to keep the tyres together as the tyre batch traverses the compression station and the packing station.

7. Apparatus according to claim 6 wherein the transfer assembly includes portions disposed on respective sides of the tyre batch for defining a space in which the tyre batch is confined, wherein the transfer assembly is arranged to move in the first direction with the tyre batch as the tyre batch traverses the compression station and the packing station.

8. Apparatus according to claim 7 wherein the portions of the transfer assembly comprise respective vertical walls extending perpendicular to the first direction and spaced apart horizontally in a third direction perpendicular to the first direction, a spacing between the walls being adjustable.

9. Apparatus according to claim 8 wherein each wall is defined by vertical posts spaced apart in the first direction.

10. Apparatus according to claim 6, wherein the transfer assembly comprises at least four vertically retractable holding bars arranged in transversely spaced pairs disposed on either side of a path along which the tyre batch is conveyed in the first direction between the compression station and the packing station, the holding bars being movable in the first direction and in a direction parallel to the first axis.

11. Apparatus according to claim 1 wherein the compression mechanism comprises a pair of substantially horizontal compression plates arranged to receive therebetween a batch, wherein a vertical distance between the compression plates is adjustable.

12. Apparatus according to claim 11 wherein the horizontal compression plates have respective surfaces facing one another, each compression plate having one of the compression conveyors disposed on its respective surface for moving the tyre batch while the tyre batch is compressed.

13. Apparatus according to claim 12 wherein one of the plates comprises a vibratory table.

14. Apparatus according to claim 12 wherein at least one of the compression plates includes two lateral flaps that are retractable.

15. Apparatus according to claim 12 wherein the packing conveyors are arranged in respective substantially horizontal planes, and are separated vertically from one another by a distance which can be adjusted such that the packing conveyors are alignable with respective compression plates when the tyre batch is compressed by a maximum amount.

16. Apparatus according to claim 15 wherein the first winder mechanism comprises a stretch-wrapping bundler.

17. Apparatus according to claim 15 wherein the second winder mechanism is arranged to helically wind the second strap such that successive turns of the strap overlap one another.

18. Apparatus according to claim 1 wherein a downstream portion of each of the packing conveyors comprises shoulders that form parallel ridges arranged at respective sides of the downstream portion extending in the first direction; the shoulders orientated vertically and being of a height such that horizontal planes passing through respective ridges are located below and above the packing conveyor.

19. Apparatus according to claim 1 wherein the downstream portion of a lower one of the packing conveyors is pivotable up and down about a horizontal axis oriented parallel to the first direction.

20. Apparatus according to claim 1 further comprising a clearing station, disposed downstream of the packing station and aligned therewith in the first direction, from which packaged tyre batches are removed.

21. Apparatus according to claim 20 wherein the clearing station includes a conveyor arranged to support the packaged tyre batch thereon and including gaps spaced apart in the first direction for accommodating a forklift.

22. Apparatus according to claim 1, wherein at least one of the compression conveyors is driven.

23. Apparatus according to claim 22, wherein at least one of the packing conveyors is driven.

* * * * *